United States Patent [19]

Shibayama et al.

[11] Patent Number: 5,047,317

[45] Date of Patent: Sep. 10, 1991

[54] SILVER HALIDE PHOTOGRAPHIC LIGHT-SENSITIVE MATERIAL

[75] Inventors: Shigeru Shibayama; Shunichi Aida; Toshio Aizu; Shunji Takada, all of Kanagawa, Japan

[73] Assignee: Fuji Photo Film Co., Ltd., Kanagawa, Japan

[21] Appl. No.: 593,592

[22] Filed: Oct. 5, 1990

Related U.S. Application Data

[63] Continuation of Ser. No. 308,224, Feb. 9, 1989, abandoned.

[30] Foreign Application Priority Data

Feb. 9, 1988 [JP] Japan ..... 63-28444
Mar. 28, 1988 [JP] Japan ..... 63-74251

[51] Int. Cl.[5] ..... G03C 1/34

[52] U.S. Cl. ..... 430/564; 430/551; 430/569; 430/607

[58] Field of Search ..... 430/551, 564, 567, 569, 430/607

[56] References Cited

U.S. PATENT DOCUMENTS

| | | | |
|---|---|---|---|
| 3,519,426 | 7/1970 | Halwig | 430/569 |
| 4,418,142 | 11/1983 | Langen et al. | 430/607 |
| 4,520,098 | 5/1985 | Dickerson | 430/495 |
| 4,639,415 | 1/1987 | Kaneko et al. | 430/551 |
| 4,693,965 | 9/1987 | Ihama et al. | 430/569 |
| 4,695,535 | 9/1987 | Bryan et al. | 430/569 |
| 4,704,349 | 11/1987 | Kriebel | 430/406 |
| 4,704,351 | 11/1987 | Takiguchi et al. | 430/567 |
| 4,705,747 | 11/1987 | Klötzer et al. | 430/550 |

FOREIGN PATENT DOCUMENTS

| | | |
|---|---|---|
| 2744489 | 4/1978 | Fed. Rep. of Germany . |
| 2253142 | 11/1987 | Japan . |
| 0720409 | 3/1980 | U.S.S.R. . |

OTHER PUBLICATIONS

T. T. Baker, "Photographic Emulsion Technique," 1948, pp. 1–5, American Photographic Publishing Co., Boston.

Sowinski et al., "Minimizing Photographic Sensitivity to Environmental Radiation by Controlling Silver Halide Emulsion Morphology", Journal of Imaging Science, 31(4), 162–168 (Jul./Aug. 1987).

*Primary Examiner*—Hoa Van Le

*Attorney, Agent, or Firm*—Sughrue, Mion, Zinn, Macpeak & Seas

[57] ABSTRACT

A silver halide photographic light-sensitive material having at least one light-sensitive silver halide emulsion layer on a support, wherein the ratio of the total weight of potassium ion in the photographic light-sensitive material to the total weight of silver in the photographic light-sensitive material is $1\times10^{-3}$ or less. The silver halide photosensitive material is improved in long-term storage stability.

11 Claims, No Drawings

SILVER HALIDE PHOTOGRAPHIC LIGHT-SENSITIVE MATERIAL

This is a continuation of application Ser. No. 07/308,224 filed Feb. 9, 1989, now abandoned.

FIELD OF THE INVENTION

This invention relates to a silver halide photographic light-sensitive material. More particularly, it relates to high sensitivity photographic light-sensitive material which has improved technology relating to attenuation of the increase in fogging and the worsening of graininess with the passage of time following the manufacturing process.

BACKGROUND OF THE INVENTION

With recent advances in various technologies in the field of silver halide photosensitive materials, photosensitive materials have come to the market in recent years which have sensitivities exceeding 400 or even 1000 on the ISO scale. There is a demand, however, for even higher sensitivities for photosensitive materials which are used in photography in dark rooms without a flash, in high shutter speed photography using telephoto lenses such as in sports photography, and in long exposure photography such as in astronomical photography. Thus, the perpetual goal facing this industry is to continue to expand the range of photography through the development of even higher sensitivity photographic materials.

A great deal of effort has been put into making photosensitive materials of even higher sensitivity. Some of these methods involve changing the shape of the silver halide particles, increasing chemical sensitivity, increasing the spectral sensitivity, using additives, or altering the coupler structure. Several useful inventions have resulted from this research. However, the requirements for high sensitivity photosensitive materials has outstripped the pace of the progress. The regrettable truth is that the above methods remain insufficient to fulfill these requirements. In this industry, the usual method for preparing high sensitivity photosensitive materials is to increase the size of the silver halide emulsion particles in conjunction with using some additional technology. While sensitivity can be increased to a certain degree by increasing the particle size in the silver halide emulsion, so long as the amount of the silver halide is kept constant, the natural result from this is to reduce the number of the silver halide emulsion particles, thereby reducing the developing initiator points, and deteriorating graininess. Methods which have been proposed to improve upon this situation include British Patent 923,045 and JP-B-49-15495 (the term "JP-B" as used herein means an "examined Japanese patent publication") which propose photographic materials having two or more emulsion layers having the same color sensitivity but having differing sensitivity i.e., having differing silver halide particle sizes in the emulsions; JP-A-55-62454 (the term "JP-A" as used herein means an "unexamined published Japanese patent application") which proposes using a coupler having high speed reactivity; U.S. Pat. No. 3,227,554 and U.S. Pat. No. 3,632,435 which propose using a DIR compound and a DIR coupler; British Patent No. 2,083,640 which proposes using a coupler which is able to produce a mobile dye; and JP-A-60-128443 which proposes using a silver halide having a high average silver iodide content. These methods all produce good results in their respective areas and excellent inventions, but the technology they offered is still insufficient to satisfy the demands for obtaining higher sensitivity and higher image quality. At this point, in order to increase the number of developing initiator points with increasing the size of the silver halide emulsion particles, the content of silver halite particles of a high sensitivity color negative photographic materials have been increased in such an amount that characteristics such as desilvering property during a bleach fixing process are not deteriorated.

However, when the above process was used to obtain high sensitivity, high image quality photosensitive materials, it was found that there were a number of undesirable properties associated with it. For example, it was found that in the period during the time following the manufacture until the materials were used, fogging increases and graininess also increases to degrade the photographic properties of the materials. In particular, the increase in fogging was so dramatic as to pose problems in using the materials. It has been reported that the reasons for the increase in fogging of photosensitive materials during long periods of time, in addition to the normal reasons of heat and humidity induced fogging, involves what is called environmental radiation from $\gamma$-rays and irradiation from space. However, the inventors own research has recently indicated that there may be additional factors involved in this increase in fogging. As a result of exhaustive research on this matter, the inventors have discovered that one other reason for the fogging is the quantity of potassium ion in the photosensitive materials.

This potassium ion is introduced into the silver halide emulsion when it is prepared or when the pAg of the emulsion is controlled, as KCl, KBr, KI, or as a part of dyes, gelatin or reagents which are added to the photosensitive materials. It was surprising indeed to find that when large quantities of potassium were present in the photosensitive materials their properties would decline with the passage of time. Since there had been no previous finding of the adverse effects caused by potassium ion in the photosensitive materials, any countermeasure had not been established with respect to the amount of potassium, and more particularly the amount of potassium ion, in photosensitive materials and that fact has been a big problem.

SUMMARY OF THE INVENTION

The first object of this invention is to provide silver halide photosensitive materials capable of providing high quality images, and the second objective is to provide silver halide photosensitive materials which have exceedingly small levels of deterioration of photographic properties, such as increased fogging and deteriorated graininess, following long-term storage of the photosensitive materials.

The objects of this invention have been accomplished by providing a silver halide photographic light-sensitive material having at least one light-sensitive silver halide emulsion layer on a support which material is characterized by the weight ratio of the total amount of potassium ion in the photographic material to the total amount of silver in the photographic material of $1\times10^{-3}$ or less.

DETAILED DESCRIPTION OF THE INVENTION

The particulars of the structure of this invention will be described below.

In this invention, when the weight ratio of the amount of potassium ion to the total amount of silver contained within the photographic materials exceeds $1\times10^{-3}$, then with the passage of time, fogging and deterioration of graininess increase to the point where the objects of this invention cannot be met. In this invention, the amount of potassium ion contained within the photographic material in terms of its weight ratio to the total amount of silver must be $1\times10^{-3}$ or less, preferably $5\times10^{-4}$ or less, and even more preferably, $3\times10^{-4}$ or less.

In the present invention the total amount of silver includes the amounts of all silver present in a photographic material as a simple substance or a compound (e.g., colloidal silver and silver in silver halide).

There are a number of known methods to determine the amount of potassium ion contained in photographic materials. Atomic absorption spectroscopy, for example, is a simple and convenient method for doing so. It is also possible to determine the amount of silver contained in the photosensitive materials by a number of methods, but elemental analysis using atomic absorption spectroscopy or fluorescent X-ray are convenient.

Photographic materials are an extremely complex system. For example, in order to prepare one emulsion, one must normally use 30 or more chemical compounds including silver nitrate, alkali halide, gelatin, acid, alkali, precipitating agent, chemical sensitizers, spectrographic sensitizers, anti-fogging agents, stabilizers, viscosity enhancers, preservatives, etc.

It is also necessary to add color couplers as color forming substances. The normal method is to prepare these in emulsion form using gelatin, oils, or organic solvents and then add them to the materials, but any one of these emulsions normally requires 10 or more types of compounds. The color photographic materials are normally composed of about 15 layers of hydrophilic colloids, and each of those layers requires one or more photographic emulsions, one or more emulsified substances, and a variety of additives such as film hardners, coating aid, etc. Thus, an exceedingly large number of chemical compounds is required in order to prepare one type of photosensitive material. Many of these compounds large contain potassium ion. Efforts to reduce the amount of potassium ion, accordingly, would involve reviewing the large number of chemical compounds used and substituting them with compounds containing no potassium ion. For example, when preparing the silver chloride, silver bromide and silver iodide, KCl, KBr, or KI which is used as alkali halide have achieved wide ranging use because they are easily and inexpensively obtained in a highly pure form. KBr, $KNO_3$ and KOH are also widely used in adjusting the pAg, the concentration of salts, and pH of the emulsion. In addition, large numbers of $K^+$ ions are contained as impurities in gelatin. A large amount of $K^+$ ions can also be present in viscosity enhancers, spectrographic sensitivity enhancers, stabilizers, anti-fogging agents, and in color couplers.

It is necessary to make very exhaustive efforts in this invention to substitute compounds in this invention which is pure, inexpensive and do not contain $K^+$ ion for those which do, and to controle changes in characteristics which occur due to the substitution.

Examples of ions which can be preferably used as those instead of potassium ion are $H^+$, $Li^+$, $Na^+$, $Mg^{2+}$, $Ca^{2+}$ and quaternary ammonium cations represented by the following formula:

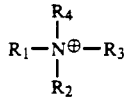

where $R_1$, $R_2$, $R_3$ and $R_4$ each represents hydrogen, an alkyl group having from 1 to 4 carbon atoms or a substituted alkyl group having from 1 to 8 carbon atoms, or $R_1$ and $R_2$ may be combined to form an atomic group necessary to form a heterocyclic group preferably of 5- to 7-membered containing at least one N atom.

Examples of preferred quaternary ammonium are shown below:

$\oplus NH_4$, $H_3N\oplus C_2H_5$, $H_2N\oplus(C_2H_5)_2$, $HN\oplus(C_2H_5)_3$,

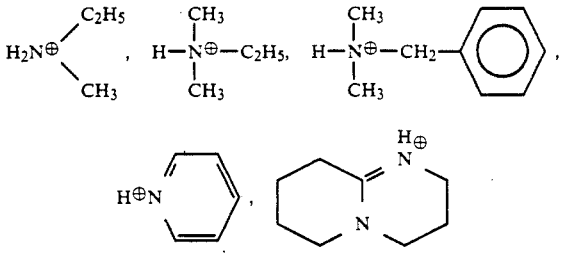

In the present invention a compound containing $K^+$ may be substituted with an equimolar of a compound containing no $K^+$.

The photographic emulsion layers in the photographic materials of this invention preferably contains from about 0 to about 30 mol % of silver iodide, which silver iodide may be included in silver iodochloride, silver iodobromide, or silver iodochlorobromide. Preferably, the layers contain from about 2 mol % to about 25 mol % of silver iodide in the silver iodobromide.

The shape of the silver halide particles in the photographic emulsion may be in the form of regular crystals such as a cube, an octahedron, or a tetradecahedron, they may be in the form of irregular crystals such as a sphere, a tabular, they may have crystal defect such as twin plane, or they may be composites thereof.

The preferred silver halide emulsion to be used in this invention is one such as described in Technical Disclosure Report 86-9598 where the external surface of the silver halide crystal surface has a Miller indices (nn1) defined as $n\geqq2$, where n is a natural number.

Silver halide particles may be fine particles having a particle diameter of about 0.2 microns or less or they may be relatively large and having a projected area diameter up to about 10 microns. The emulsion may be poly- or mono-disperse emulsion.

However, the effects of this invention are most clear when using a large size emulsion. Usually, particle size is expressed in terms of diameter of a sphere having the same volume (hereinafter referred to as sphere equivalent diameter). The effects of this invention are most dramatic when particles in the photographic material are of a size of 0.8 μm or more, preferably 1.2 μm or more, and even more preferably, 1.5 μm or more.

Silver halide emulsions which can be used in this invention can be prepared by methods described, for example, in *Research Disclosure,* (RD) No. 17643 (December, 1978), pp. 22 to 23, "I. Emulsion Preparation and Types"; in RD No. 18716 (November, 1979), p. 648; in P. Glafkides, "Chemic et Phisique Photographique" (published by Paul Montel, 1967); G. F. Duffin, "Photographic Emulsion Chemistry" (Forcal Press, 1966); and V. L. Zelikman, et al., "Making and Coating Photographic Emulsion" (Focal Press, 1964).

Monodisperse emulsions such as described in U.S. Pat. Nos. 3,574,628 and 3,655,394, and in British Patent 1413,748 may also be used.

It is also possible to use tabular particles with an aspect ratio of 5 or more in this invention. These can be prepared in a very simple manner by using the methods described in Gustoff, "Photographic Science and Engineering", Vol. 14, pp. 248 to 257 (1970); U.S. Pat. Nos. 4,434,226, 4,414,310, 4,433,048, and 4,439,520; as well as in British Patent 2,112,157.

The crystal structure may be uniform or there may be differing halogen composition between the interior and the exterior, or a laminar structure may be used. Epitaxial conjugation may also be used to bond different types of silver halides together, or, compounds other than silver halide such as rhodan silver or lead oxide may be bonded to the silver halide.

It is also possible to use a mixture of particles of differing crystal shapes.

The silver halide particles may be obtained by an acidic method, a neutral method, or an ammonium method. They may be obtained by a reaction between soluble silver salts and soluble halogen salts by a single jet method, a double jet method or a combination of the above methods.

One may also use the method of forming the particles under an excess amount of silver ions (the so-called reverse mixture method). Additionally, one may use a double jet method where the pAg in the liquid phase of the solution where the silver halide is formed is maintained at a constant level, in other words, using the so-called controlled double jet method.

One may also use a mixture of two or more silver halide emulsions prepared by separate methods.

During the process of silver halide formation or physical ripening, cadmium salts, zinc salts, lead salts, thallium salts, iridium salts or their complex salts, rhodium salts or their complex salts, iron salts or their complex salts, etc. may also be present.

The silver halide formation may take place in a low pAg environment, a high pH environment, or in the presence of an appropriate reducing agent in order to impart reduction sensitized nuclei in the interior of the particles.

Also, as described in JP-A-61-14630 and JP-A-60-122935, tetrazaindene may be present during the formation process for the silver halide emulsion to obtain an emulsion having a high silver iodide content and excellent monodispersion properties. This method is preferably implemented for the silver halide emulsion used in this invention because the thus-obtained emulsion has a high sensitivity and graininess.

Additionally, as indicated in JP-A-58-126526, since a silver halide emulsion obtained by gold-sulphur sensitization or gold-selenium sensitization which is conducted under the presence of a N-containing heterocyclic compound forms less fogs and has high sensitivity, the method is preferably used for preparation of the silver halide emulsion used in this invention.

After precipitation of the emulsion or physical ripening thereof, normally, the soluble salts are eliminated from the emulsion. A conventional method may be used, wherein gelatin is gelled to form noodles, and then they are washed with water. Additionally, an inorganic salt comprising polyvalent ion, such as sodium sulfate, an anionic surfactant, and an anionic polymer (e.g., polystyrene sulfonate) or a gelatin derivative (e.g., aliphatic acylated gelatin, aromatic acylated gelatin, aromatic carbamoylated gelatin, etc.) may be used with a flocculation method.

Normally, the silver halide emulsion used is physically ripened, chemically ripened, and spectrally sensitized. The additives which are used in these processes may be those listed in *Research Disclosures* No. 17643 and 18716. The specific applicable areas will be summarized in a table below.

The known photographic additives are listed in the above mentioned *Research Disclosures* as summarized in the Table below.

TABLE

| | Type of Additive | RD 17643 | RD 18716 |
|---|---|---|---|
| 1 | Chemical sensitizers | p. 23 | p. 648 right |
| 2 | Sensitivity enhancers | | p. 648 right |
| 3 | Spectral sensitizers Super sensitizers | p. 23 to 24 | p. 648 right to 649 right |
| 4 | Whiteners | p. 34 | |
| 5 | Anti-fogging agents and stabilizers | p. 24 to 25 | p. 649 right |
| 6 | Light absorbents, filter dyes, U.V. absorbents | p. 25 to 26 | p. 649 right to 650 left |
| 7 | Anti-staining agents | p. 25 right | p. 650 left to right |
| 8 | Color image stabilizers | p. 25 | |
| 9 | Hardeners | p. 26 | p. 651 left |
| 10 | Binders | p. 26 | p. 651 left |
| 11 | Plasticizers, lubricants | p. 27 | p. 650 right |
| 12 | Coating aids, surfactants | p. 26 to 27 | p. 650 right |
| 13 | Anti-static agents | p. 27 | p. 650 right |

This invention is applicable and effective with various types of photosensitive materials including a black and white photographic material for general used, a X-ray, color, infra-red, microscopic, transfer, diffusion transfer, high contract, and thermodevelopable photosensitive materials but it is especially appropriate for high sensitivity color photosensitive materials.

Color photographic materials are normally comprised of 10 or more hydrophilic colloid layers, and thus a relatively high quantity of emulsion and emulsified substance per unit surface area is applied. Since potassium ions are introduced into the emulsion or emulsified substances contained within the photographic materials, the total amount of potassium ions in the photographic materials increases correspondingly with the amount of the emulsion and emulsified substances. This means that this invention is most suited for application to color photographic materials.

Since high-sensitivity color photosensitive materials have large sized silver halide particles in them, this means that they are designed to have a relatively high silver halide content. This means that there is a large quantity of emulsion applied per unit surface area. Thus, the effects of this invention would be magnified by that factor. It is preferred that it be applied to color photosensitive materials having a specific photosensitivity of 320 or higher, especially, color photosensitive materials having a specific photosensitivity of 800 or more.

What is meant here by specific photosensitivity is determined in the following manner. After making a wedge exposure according to the normal methods used in sensitometry, processing using a normal processing (processing steps disclosed in Example 1) is conducted. Sensitometry is then performed on the samples with blue, green and red light. Corresponding exposures for obtaining densities 0.15 higher than minimum densities are expressed in lux-seconds as HB, HG and HR, respectively. The higher of the HB and HR value (the lower sensitivity) is taken as the HS. The specific photosensitivity S is defined by the following equation:

$$S = \sqrt{2/HG \cdot HS}$$

Thus, the higher the specific photosensitivity S, the higher the sensitivity of the sample.

As described above, however, the tendency in the industry has been to improve graininess by increasing the content of the silver halide emulsion particles as described in JP-A-58-147744. We, however, reviewed this common sense approach from the standpoint of preventing deterioration of properties with storage and found that if the silver content is greater than 9.0 g/m$^2$ then deterioration is dramatic with the passage of time when the photographic materials are stored as compared with their properties immediately after preparation. Surprisingly, when a certain level of silver content had been exceeded, the effects in improvement of graininess were diminished after storage for 6 months, when compared with the materials having the lower content of silver had better graininess because deterioration of graininess during storage is smaller.

Thus, the silver content in the photosensitive materials of this invention preferably be between 3.0 g/m$^2$ and 9.0 g/m$^2$. While definitive preferred range for silver content can not be described, since it would vary according to the structure of the layers for the photographic materials and the type of coupler used, for photographic materials with a specific photosensitivity of 320 or greater, when the silver content exceeds 9.0 g/m$^2$, when stored from 6 months to 2 years, the natural radiation exposure causes decreases in sensitivity and deterioration of graininess to the point where problems appear in practical applications. If the silver content is less than 3.0 g/m$^2$, then it tends to be difficult to secure the maximum concentrations for the color photosensitive materials which are required. Thus, for photosensitivity of 320 or higher photosensitive materials, the preferred ranges is 3.0 g/m$^2$ to 8.5 g/m$^2$, preferably, 3.0 g/m$^2$ to 8.0 g/m$^2$.

As the sensitivity of a photographic material becomes higher probability of being exposed through natural radiation also becomes higher proportionally thereto. Thus, for photosensitive materials having a specific photosensitivity of less than 320, the deterioration in properties does not pose to great of a problem when stored for 6 months or more even if the silver content is 9.0 g/m$^2$ or higher.

One or more layers each of green-sensitive emulsion, blue-sensitive emulsion, and red-sensitive emulsion are applied to a support to obtain color sensitive materials according to this invention. The order these layers may be selected freely. Normally, yellow couplers are included in the blue-sensitive emulsion layers, magenta couplers in the green-sensitive emulsion layers, and cyan couplers in the red-sensitive emulsion layers, but in some cases, other combinations may be used. In order to obtain increased sensitivity it is preferable in this invention to use two or more emulsion layers having the same color sensitivity, and having differing sensitivities, furthermore, it is more preferable to use three layers-construction with applying a method to improve graininess.

Further, there are also various inventions concerning the order of the layers which is used to obtain both of high sensitivity and high image quality. These technologies may be used in the present invention. Inventions concerning the order of the layers are described in, for example, U.S. Pat. Nos. 4,184,876, 4,129,446, 4,186,016; British Patent 1,560,965; U.S. Pat. Nos. 4,186,011, 4,267,264, 4,173,479, 4,157,917, 4,165,236; British Patent 2,138,962, JP-A-59-177552; British Patent 2,137,372; JP-A-59-180556 and JP-A-59-204038.

It is also possible to use a non-photosensitive layer between two or more emulsion layers of the same color sensitivity.

In order to increase sensitivity a reflective layer containing fine particles of silver halide may be provided under the high sensitivity layer, especially under the high sensitive green sensitive layer. This technology is disclosed in JP-A-59-160135.

Also, U.S. Pat. No. 3,497,350 and JP-A-59-214853 disclose an emulsion layer wherein a color sensitivity of an emulsion layer is combined with a coupler which forms a color which is not necessarily the complementary color to which the emulsion is sensitive, and a method to provide this layer at the greatest distance from the support. This method also may be used.

In the color photosensitive materials of this invention, a yellow filter layer is normally included. The yellow filter layer can contain colloidal silver or the yellow filter dyes disclosed in JP-A-63-40143.

Various types of color couplers may be used in this invention. Specific examples are described in patents recited in *Research Disclosure,* (RD) No. 17643, VII-C through G.

Preferred yellow couplers are disclosed in U.S. Pat. Nos. 3,933,501, 4,022,620, 4,326,024, 4,401,752; JP-B-58-10739 (the term "JP-B" as used herein means an "examined Japanese patent publication"); and British Patents 1,425,020 and 1,476,760.

Preferred magenta couplers are of 5-pyrazolone couplers and pyrazoloazole couplers such as disclosed in U.S. Pat. Nos. 4,310,619, 4,351,897; European Patent 73,636; U.S. Pat. Nos. 3,061,432, 3,725,067; *Research Disclosure,* No. 24220 (June, 1984); JP-A-60-33552; *Research Disclosure,* No. 24230 (June, 1984); JP-A-60-43659; U.S. Pat. Nos. 4,500,630 and 4,540,654, etc.

Phenol couplers and naphthol couplers may be used as cyan couplers. Cyan couplers disclosed in U.S. Pat. Nos. 4,052,212, 4,146,396, 4,228,233, 4,296,200, 2,369,929, 2,801,171, 2,772,162, 2,895,826, 3,772,002, 3,758,308, 4,334,001, and 4,327,173; West German patent (OLS) 3,329,729; European Patent 121,365A; U.S. Pat. Nos. 3,446,622, 4,333,999, 4,451,559 and 4,427,767; European Patent 161,626A, etc. are preferred.

For couplers, there are 4-equivalent couplers which react with 4 mols of silver halide to cause 1 mol of coupler coloring, or 2-equivalent couplers which react with 2 mols of silver halide to cause 1 mol of coupler coloring. The 2-equivalent coupler uses the silver most efficiently and is, therefore, preferred. The 2-equivalent couplers, however, have the problem of a high rate of amplifing fog. In this invention, however, it is preferred to use the 2-equivalents couplers due to the effects of the invention in reducing fogging.

This invention it is possible to use so-called high reaction rate couplers which have a high coupling reactivity.

In order to correct unneeded absorption of a colored dye, it is preferable to use a colored coupler such as described in *Research Disclosure,* No. 17643, paragraph VII-G; U.S. Pat. No. 4,163,670, JP-A-57-39413, U.S. Pat. Nos. 4,004,929 and 4,138,258, and British Patent 1,146,368.

Preferred examples of couplers which form colored dyes having suitable diffusion properties include those described in U.S. Pat. No. 4,366,237, British Patent 2,125,570, European Patent 96,570, and West German Patent (OLS) 3,234,533.

Typical examples of polymerized dye-forming couplers are those disclosed in U.S. Pat. Nos. 3,451,820, 4,080,211, and 4,367,282; and British Patent 2,102,173.

Couplers which release photographically useful residual groups in conjunction with the coupling process are also useful in this invention. As DIR couplers which release a developing inhibitor described in the above mentioned RD17643, paragraphs VII-F, JP-A-57-151944, JP-A-57-154234, JP-A-60-184248, and U.S. Pat. No. 4,248,962 are preferred.

Preferred examples of couplers which release nucleus-forming agent or a developing accelerator during development are those described in British Patents 2,097,140 and 2,131,188, JP-A-59-157638, and JP-A-59-170840.

In addition, other couplers which may be used in the photosensitive materials of this invention include those disclosed in, for example, U.S. Pat. No. 4,130,427, which discloses a competitive coupler; U.S. Pat. Nos. 4,283,472, 4,338,393, and 4,310,618 which disclose multi-equivalent couplers; JP-A-60-185950, JP-A-62-24252 disclose DIR redox compound releasing couplers, DIR redox compound releasing redox compounds, DIR coupler releasing couplers, or DIR coupler releasing redox compounds; European Patent 173,302A, which discloses a coupler which releases a dye which recolors after releasing; RD. Nos. 11449 and 24241 as well as JP-A-61-201247 which discloses bleach accelerator-leleasing couplers; and U.S. Pat. No. 4,553,477 which discloses a ligand-releasing coupler.

The couplers used in this invention may be introduced into the photographic materials by any conventional of dispersion methods.

An example of the high boiling point solvent used in the oil in water dispersion method is described, for example, in U.S. Pat. No. 2,322,027.

Specific examples of these high boiling point organic solvents, used in the oil in water dispersion method, which have boiling points of 175° C. or higher at normal temperature include: phthalic acid esters (e.g., dibutyl phthalate, dicyclohexyl phthalate di-2-ethylhexyl phthalate, decyl phthalate, bis(2,4-di-t-amylphenyl) phthalate, bis(2,4-di-t-amylphenyl) isophthalte, bis(1,1-diethyl propyl) phthalate, etc.); phosphoric acid or phosphonic acid esters (e.g., triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, trichloropropyl phosphate, di-3-ethylhexyl phenyl phosphonate, etc.); benzoic acid esters (e.g., 2-ethylhexyl benzoate, dodecyl benzoate, 2-ethylhexyl-p-hydroxy benzoate, etc.); amides (e.g., N,N-diethyldodecane amide, N,N-diethyl lauryl amide, N-tetradecyl pyrrolidone, etc.); alcohols and phenols (e.g., isostearyl alcohol, 2,4-di-tert-amylphenol, etc.); aliphatic carboxylic acid esters (e.g., bis(2-ethylhexyl) sebacate, dioctyl azelate, glycerol tributylate, isostearyl lactate, trioctyl citrate, etc.); aniline derivatives (e.g., N,N-dibutyl-2-butoxy-5-tert-octyl aniline, etc.); and hydrocarbons (e.g., paraffin, dodecyl benzene, diisopropyl naphthalene, etc.). Auxiliary solvents having a boiling point of 30° C. or higher, preferably between 50° C. and 160° C. may also be used. Typical organic solvents so used include ethyl acetate, butyl acetate, ethyl propionate, methylethyl ketone, cyclohexanone, 2-ethoxyethyl acetate, dimethyl formamide, etc.

Examples of the latex dispersion method, effects, and impregnation latexes are disclosed in U.S. Pat. No. 4,199,363 and in West German Patent Applications (OLS) 2,541,274 and 2,541,230.

This invention may be applied to various types of color photographic light-sensitive materials. Representative examples are color negative films for general-purpose usage and for film making; color reversal film for slides and T.V. cameras, and in color positive film and color reversal paper, etc.

Supports which are appropriate for use in this invention include those described in the above mentioned RD No. 17643, pp. 28 and in No. 18716, p. 647 right column through 648 left column.

The color photographic materials of this invention may be developed by normal methods such as described in the above mentioned RD. No. 17643 pp. 28 through 29 and in RD No. 18716, pp. 651 left and right columns.

The color developing solution for developing the photographic materials of this invention preferably is an alkaline aqueous solution which contains an aromatic primary amine color developer as its primary ingredient. Aminophenol compounds are useful as the color developer ingredient, but p-phenylene diamine compounds are preferred. Representative examples of them include 3-methyl-4-amino-N,N-diethyl aniline, 3-methyl-4-amino-N-ethyl-N-$\beta$-hydroxyethyl aniline, 3-methyl-4-amino-N-ethyl-N-$\beta$-methane sulfonamidoethylaniline, 3-methyl-4-amino-N-ethyl-N-$\beta$-methoxyethyl aniline, as well as their sulfates, chlorides, or p-toluene sulfonates, etc. Depending upon one's objectives, 2 or more of the above compounds may be used in combination.

The color developing solution also normally contains pH buffers such as carbonate, phosphate, or borate salts of alkali metals, and developing inhibitors or anti-fogging agents such as bromides, iodides, benzimidazoles, benzo thiazols, or mercapto-compounds. If desired, various types of preservatives (e.g., hydroxyamine, diethyl hydroxyl amine, hydrozine zinc sulfates, phenyl semicarbazides, triethanol amine, catechol sulfonic acids, triethylene diamine(1,4-diazabicyclo[2,2,2]octanes); organic solvents (e.g., ethylene glycol, diethylene glycol); developing accelerators (e.g., benzyl alcohol, polyethylene glycol, quaternary ammonium salts, amines), dye forming couplers, or competitive couplers etc.); fogging agents such as sodium bromohydride; auxiliary developing agents such as 1-phenyl-3-pyrrazolidone; viscosity enhancers and chelating agents (e.g., aminopoly carboxylic acid, aminopoly phosphonic acid, alkyl phosphonic acid, phosphocarboxylic acid); (e.g., ethylene diamine tetracetic acid, nitrilo triacetate, diethylene triamine pentaacetic acid, cyclohexane diamine tetraacetic acid, hydroxyethyl imino diacetic acid, 1-hydroxy ethylidene 1,1-diphosphonic acid, nitrilo-N,N,N-trimethylene phosphonic acid, ethylene diamine-N,N,N',N'-tetramethylene phosphonic acid, ethylene diamine-di(o-hydroxyphenyl acetic acid), and their salts, etc.

When reversal processing is to be implemented, the color development is normally accomplished after the black and white development. The black and white developing solution may contain one or combination of conventional black and white developing agents, including dihydroxy benzenes (e.g., hydroquinone); 3-pyrazolidones (e.g., 1-phenyl-3-pyrazolidone), or aminophenols (e.g., N-methyl-p-aminophenol).

The color and the black and white developer generally has a pH of from 9 to 12. The amount of replenisher in these developing solutions used differs according to the color photosensitive materials being processed, but normally, it is 3 liters or less per square meter of photosensitive materials. By decreasing the bromide ion concentration, it is possible to use 500 ml or less of replenisher. When the amount of replenisher used is decreased, it is possible to decrease the contact surface with the air in the processing tank, which prevents the evaporation and oxidation of the solution. By implementing some means to hold down the buildup of bromide ions in the developer solution, it is possible to decrease the amount of replenisher used.

Generally, a bleach processing is implemented for the photographic emulsion layers following the color development. The fixing may be performed at the same time as the bleaching (bleach-fixing processing), or they may also be performed separately. In order to speed up the processing, a bleach fixing-processing may be performed after a bleach processing. Two bleach-fixing baths which are continuously connected can also be used for a continuous processing, or fixing can be performed prior to bleach-fixing, or bleaching can be performed after bleach-fixing as desired. Bleaching agents which may be used include compounds of a polyvalent metal (e.g., iron(III), cobalt(III), chrome(VI), copper(II), etc.); peroxides, quinones, or nitro compounds. Representative bleaching agents include ferricyanides, dichromates; organic complex salts of iron(III) or cobalt(III) of aminopoly carboxylates (e.g., ethylene diamine tetraacetate, diethylene triamine pentaacetate, cyclohexane diamine tetraacetate, methylimino diacetate, 1,3-diamino propane tetraacetate, glycol eather amine tetraacetate) citric acid, tartaric acid or maleic acid; persulfates, bromates, permanganates, nitrobenzenes, etc. Among the above, iron(III) ethylene diamine tetraacetate complex salt and other iron(III) amino polycarboxylate complex salts and persulfate salts provide for speedy processing and help prevent environmental pollution, so they are preferred. Furthermore, iron(III) amino polycarboxylate complex salts are useful in bleach solutions and in bleach-fixing solutions. Bleach-fixing solutions containing these iron(III) amino polycarboxylate complex salts generally have a pH of from 5.5 to 8, however in order to conduct treatment in a higher speed the treatment may be conducted under a further lower pH.

One may also use bleach acceralating agents in, bleach solutions, bleach-fixing solutions or prebaths thereof as desired. Useful bleach accelerating agents include those disclosed in the following specifications: compounds containing mercapto groups or disulfide groups (e.g., U.S. Pat. No. 3,893,858, West German Patents 1,290,812 and 2,059,988, JP-A-53-32736, JP-A-53-57831, JP-A-53-37418, JP-A-53-72623; JP-A-53-95630; JP-A-53-95631; JP-A-53-104232, JP-A-53-124424, JP-A-53-141623, JP-A-53-28426; *Research Disclosure,* No. 17129, (July, 1978); thiazolidine derivatives (e.g., JP-A-50-140129); thiourea derivatives (e.g., JP-B-45-8506, JP-A-52-20832, JP-A-53-32735, and U.S. Pat. No. 3,706,561); iodides (e.g., West German Patent 1,127,715, JP-A-58-16235); polyoxy ethylene compounds (e.g., West German Patents 966,410 and 2,748,430); polyamine compounds (e.g., JP-B-45-8836); other compounds (JP-A-49-42434, JP-A-49-59644, JP-A-53-94927, JP-A-54-35727; JP-A-55-26506, JP-A-58-163940); and bromide ions, etc. Among the above, compounds containing mercapto group and disulfide group are preferred due to the magnitude of their acceralating effects; in particular, those described in U.S. Pat. No. 3,893,858; West German Patent 1,290,812; and JP-A-53-95630 are preferred. The compounds described in U.S. Pat. No. 4,552,834 are also preferred. These bleaching acceralators may be added to the photographic materials. These bleaching acceralators are particularly effective during the bleach-fixing of the color photographic materials used for photography.

One may use thiosulfates, thiocyanates, thioether compounds, thioureas, or large quantities of iodide as the fixer, but the use of thiosulfates is most common. Ammonium thiosulfate enjoys the most wide ranging usage. Sulfites, bisulfites or carbonyl bisulfite additives are preferred as preservatives for the bleach-fixing solutions.

After the desilvering processing for the silver halide color photographic light-sensitive materials of this invention, water washing and/or stabilizing processing is normally undertaken. The amount of water used in the water washing process depends upon the characteristics of the photographic materials (depends upon materials used therein, for example, couplers etc.), the use of the photographic material, the temperature of the water, the number (stages) of the water wash tanks, the temperature of the water-washing, the replenishing method, such as counter flow and normal flow, and other conditions, so it may vary within a wide range. When using a multi-stage counter flowing system, the relationship between the number of washing water tanks and the amount of water may be determined according to "Journal of the Society of Motion Picture and Television Engineers," Vol 64, pp. 248 to 253 (May, 1955).

Using the multi-stage counter flow method described in the above document, it is possible to greatly reduce the amount of water used, but problems can arise from increasing the water retention time in the tanks, the growth of bacteria, or the adhesions of free floating substances to the photographic materials. In the processing of the color photosensitive materials of this invention, the above mentioned problems may be resolved very effectively by reducing the calcium and magnesium content according to the method described in JP-A-62-288838. In addition, isothiazolone compounds described in JP-A-57-8542, thiabendazoles, or chlorine containing antiseptics such as chlorirated sodium isothianurate may be used. Additionally, benzotriazoles may be used as antiseptics, according to "Bokin Bobizai no Kagaku" (Chemistry of Antiseptic and Antimold Agents) by Hiroshi Horiguchi; "Biseibutsu no Genkin, Sakkin, Bobi Gijutsu" (Reduction of Microorganisms, Antiseptic, and Mold-Preventing Technology)

edited by Eisai Gijutsu-kai (Association of Hygiene Technology); or in "Bokin Bobizai Jiten" (Dictionary of Antiseptics and Mold-Preventing Agents) edited by Nippon Bokin Bobi Gakkai (Japanese Academy of Antiseptics and Mold-Preventing Agents).

The pH of the wash water in the processing of the photographic materials of this invention should be 4 to 9, preferably 5 to 8. Various parameters may be established for the temperature of the wash water and washing time depending upon the characteristics of the photographic materials and their application, but normally, temperature is 15° to 45° C. and time is 20 seconds to 10 minutes; preferably 25° to 40° C. and 30 seconds to 5 minutes. It is also possible to eliminate the above described water wash and directly implement stabilization processing. Such stabilization processing is well known to the art and described in JP-A-57-8543, JP-A-58-14834, and JP-A-60-220345.

Additionally, there are certain cases where stabilization processing would follow the above described water wash. An example of this would be the use of a final bath for photographic color light-sensitive materials which would be a stabilizer bath including formalin and a surfactant. Various types of chelating agents and antimold agents may also be added to this stabilizer bath.

One may reutilize any overflow from the above described water wash and/or stabilizer liquid replenishment processes in the desilvering process or other processes.

In order to speed up and simplify the processing of the silver halide color photographic materials of this invention, the color developing agent may be included within the materials. This inclusion is preferably accomplished using various types of precursors of the color developing agent. Examples include indoaniline compounds as in U.S. Pat. No. 3,342,597, Schiff base compounds (e.g., as in U.S. Pat. No. 3,342,599 and *Research Disclosure,* Nos. 14850 and No. 15159); aldol compounds (e.g., *Research Disclosure,* No. 13924); metal complex salts (U.S. Pat. No. 3,719,492), or urethane compounds as in JP-A-53-135628.

In order to promote color developing, one may also include various types of 1-phenyl-3-pyrazolidones in the silver halide color photographic materials of this invention. Typical compounds appear in JP-A-56-64339, JP-A-57-144547, and JP-A-58-115438.

The various processing solutions used in this invention are between 10° C. and 50° C. Normally, the standard is processing at 33° C. to 38° C., with the higher processing temperatures serving to shorten processing time, and lower processing temperatures serving to improve image quality and stability of the processing solutions. One may also conserve silver in the photographic materials by using cobalt or hydrogen peroxide intensification as specified in West German Patent 2,226,770 and U.S. Pat. No. 3,674,499.

The silver halide photographic materials of the present invention may also be applied to heat-developable photographic materials described in U.S. Pat. No. 4,500,626, JP-A-60-133449, JP-A-59-218443; JP-A-61-238056, or European Patent 210,660A2.

The effects of this invention are to improve photographic properties such as reducing the increase in fogging and worsening of graininess after long term storage of the photosensitive materials. These effects allow for this invention to provide a silver halide photographic light-sensitive material which have high image quality. These effects are obtained by a silver halide photographic light-sensitive material having at least one light-sensitive silver halide emulsion layer on a support, wherein the silver halide photographic material has the weight ratio of the total amount of potassium ion to the total amount of silver of $1\times10^{-3}$ or less. The measures listed in paragraphs (a) through (d) below are most effective taking advantage of the reduced amount of potassium ion, and if more than one of these are implemented, the effects from this reduction are even more dramatic.

(a) A silver halide photographic light-sensitive material having on a support at least one photosensitive silver halide emulsion layer containing silver halide particles having a sphere equivalent diameter of at least 0.8 μm.

(b) A color photosensitive material having at least one of each of blue-sensitive emulsion layer, green-sensitive emulsion layer, and red sensitive emulsion layer as light-sensitive silver halide emulsion layers on a support.

(c) A color photographic matrial of (b) having a specific color sensitivity of 320 or higher.

(d) A color photographic matrial of (b), wherein the total amount of silver in the photographic material is from 3.0 to 9.0 g/m².

This invention will be described in further detail below through examples, but it is not limited to these examples.

EXAMPLES 1

The below described layers 1 through 18 were applied to an undercoated support of cellulose triacetate film to prepare high sensitivity multilayered color negative photographic materials. The total silver content of the film was 5.7 g/m². This photographic material was called Sample 101.

COMPOSITION OF PHOTOGRAPHIC LAYERS

The amount of coating is expressed for each of the layers in terms of g/m²; the amount of silver halide is expressed in terms of the weight of the silver. However, in the case of sensitizing dyes, the amount is expressed in terms mol of dye/mol of silver halide in that same emulsion layer.

| | |
|---|---|
| Layer 1: Antihalation Layer | |
| Black colloidal silver | 0.2 (silver content) |
| Gelatin | 2.2 |
| UV-1 | 0.1 |
| UV-2 | 0.2 |
| Cpd-1 | 0.05 |
| Solv-1 | 0.01 |
| Solv-2 | 0.01 |
| Solv-3 | 0.08 |
| Layer 2: Intermediate Layer | |
| Fine silver bromide particles (spherie equivalent diameter was 0.7 μm) | 0.15 (amount of silver) |
| Gelatin | 1.0 |
| Cpd-2 | 0.2 |
| Layer 3: First Red-Sensitive Emulsion Layer | |
| Silver iodobromide particles (AgI 10.0 mol %, internally high AgI content type, sphere equivalent diameter 0.7 μm sphere equivalent diameter variation coefficient 14%, tetradecahedral particles) | 0.26 (silver content) |
| Silver iodobromide particles (AgI 4.0 mol %,internally high | 0.2 (silver |

-continued

| | |
|---|---|
| AgI content type, silver sphere equivalent diameter 0.4 μm, sphere equivalent diameter variation coefficient 22%, tetradecahedral particles) | content) |
| Gelatin | 1.0 |
| ExS-1 | $4.5 \times 10^{-4}$ |
| ExS-2 | $1.5 \times 10^{-4}$ |
| ExS-3 | $0.4 \times 10^{-4}$ |
| ExS-4 | $0.3 \times 10^{-4}$ |
| ExC-1 | 0.33 |
| ExC-2 | 0.009 |
| ExC-3 | 0.023 |
| ExC-6 | 0.014 |
| Layer 4: Second Red-Sensitive Emulsion Layer | |
| Silver iodobromide particles (AgI 16 mol %, internally high AgI content type, sphere equivalent diameter 1.0 μm sphere equivalent variation coefficient 25%, tabular particles, diameter/thickness ratio 4.0) | 0.55 (silver content) |
| Gelatin | 0.7 |
| ExS-1 | $3.0 \times 10^{-4}$ |
| ExS-2 | $1.0 \times 10^{-4}$ |
| ExS 3 | $0.3 \times 10^{-4}$ |
| ExS 4 | $0.3 \times 10^{-4}$ |
| ExC-6 | 0.08 |
| ExC-3 | 0.05 |
| ExC-4 | 0.10 |
| Layer 5: Third Red-Sensitive Emulsion Layer | |
| Silver iodobromide particles (AgI 10.0 mol %, internally high AgI content type, sphere equivalent diameter 1.2 μm sphere equivalent variation coefficient 28%, tabular particles, diameter/thickness ratio 6.0) | 0.9 (silver content) |
| Gelatin | 0.6 |
| ExS-1 | $2.0 \times 10^{-4}$ |
| ExS-2 | $0.6 \times 10^{-4}$ |
| ExS-3 | $0.2 \times 10^{-4}$ |
| ExC-4 | 0.07 |
| ExC-5 | 0.06 |
| Solv-1 | 0.12 |
| Solv-2 | 0.12 |
| Layer 6: Intermediate Layer | |
| Gelatin | 1.0 |
| Cpd-4 | 0.1 |
| Layer 7: Intermediate Layer | |
| Silver iodobromide particles (AgI 10.0 mol %, internally high AgI content type, sphere equivalent diameter 0.7 μm sphere equivalent diameter coefficient 14%, tetradecahedral particles) | 0.2 (silver content) |
| Silver iodobromide particles (AgI 14 mol %, internally high AgI content type, sphere equivalent diameter 0.4 μm, sphere equivalent diameter variation coefficient 22%, tetradecahedral particles) | 0.1 (silver content) |
| Gelatin | 1.2 |
| ExS-5 | $5.0 \times 10^{-4}$ |
| ExS-6 | $2.0 \times 10^{-4}$ |
| ExS-7 | $1.0 \times 10^{-4}$ |
| ExM-1 | 0.41 |
| ExM-2 | 0.10 |
| ExM-5 | 0.03 |
| Solv-1 | 0.2 |
| Layer 8: Second Green-Sensitive Layer | |
| Silver iodobromide particles (A9I 10 mol %, internally high iodine content type, sphere equivalent diameter 1.0 μm sphere equivalent diameter variation coefficient 25%, tabular particles, diameter/thickness ratio 3.0) | 0.4 (silver content) |
| Gelatin | 0.35 |
| ExS-5 | $3.5 \times 10^{-4}$ |
| ExS-6 | $1.4 \times 10^{-4}$ |
| ExS-7 | $0.7 \times 10^{-4}$ |
| ExM-1 | 0.09 |
| ExM-3 | 0.01 |
| Solv-1 | 0.15 |

-continued

| | |
|---|---|
| Layer 9: Intermediate Layer | |
| Gelatin | 0.5 |
| Layer 10: Third Green-Sensitive Emulsion Layer | |
| Silver iodobromide particles (AgI 10 mol %, internally high AgI content type, sphere equivalent diameter 1.2 μm, sphere equivalent diameter variation coefficient 28%, tabular particles, diameter/thickness ratio 6.0) | 1.0 (silver content) |
| Gelatin | 0.8 |
| ExS-5 | $2.0 \times 10^{-4}$ |
| ExS-6 | $0.8 \times 10^{-4}$ |
| ExS-7 | $0.8 \times 10^{-4}$ |
| ExM-4 | 0.04 |
| ExM-3 | 0.01 |
| ExC-4 | 0.005 |
| Solv-1 | 0.2 |
| Layer 11: Yellow Filter Layer: | |
| Cpd-3 | 0.05 |
| Gelatin | 0.5 |
| Solv-1 | 0.1 |
| Layer 12: Intermediate Layer | |
| Gelatin | 0.5 |
| Cpd-2 | 0.1 |
| Layer 13: First Blue-Sensitive Emulsion Layer | |
| Silver iodobromide particles (AgI 10 mol %, internally high iodine content type, sphere equivalent diameter 0.7 μm, sphere equivalent diameter variation coefficient 14%, tetradecahedral particles) | 0.1 (silver content) |
| Silver iodobromide particles (AgI 4 mol %, internally high iodine content type, sphere equivalent diameter 0.4 μm, sphere equivalent diameter variation coefficient 22%, tetradecahedral particles) | 0.05 (silver content) |
| Gelatin | 1.0 |
| ExS-8 | $3.0 \times 10^{-4}$ |
| ExY-1 | 0.53 |
| ExY-2 | 0.02 |
| Solv-1 | 0.15 |
| Layer 14: Second Blue-Sensitive Emulsion Layer | |
| Silver iodobromide particles (AgI 19 mol %, internally high AgI content type, sphere equivalent diameter 1.0 μm, sphere equivalent diameter variation coefficient 16%, tetradecahedral particles) | 0.19 (silver content) |
| Gelatin | 0.3 |
| ExS-8 | $2.0 \times 10^{-4}$ |
| ExY-1 | 0.22 |
| Solv-1 | 0.07 |
| Layer 15: Intermediate Layer | |
| Fine particles of silver iodobromide (AgI 2 mol %, uniform type, sphere equivalent diameter 0.13 μm) | 0.2 (silver content) |
| Gelatin | 0.36 |
| Layer 16: Third Blue-Sensitive Emulsion Layer | |
| Silver iodobromide particles (AgI 14 mol %, internally high AgI type, sphere equivalent diameter 1.5 μm, sphere equivalent diameter variation coefficient 28%, tabular particles, diameter/thickness ratio 5.0) | 0.1 (silver content) |
| Gelatin | 0.5 |
| ExS-8 | $1.5 \times 10^{-4}$ |
| ExY-1 | 0.2 |
| Solv-1 | 0.07 |
| Layer 17: First Protective Layer | |
| Gelatin | 1.8 |
| UV-1 | 0.1 |
| UV-1 | 0.2 |
| Solv-1 | 0.01 |
| Solv-2 | 0.01 |
| Layer 18: Second Protective Layer | |
| Fine silver bromide particles (sphere equivalent diameter 0.07 μm | 0.18 (silver content) |
| Gelatin | 0.7 |

-continued

| | |
|---|---|
| Polymethyl methacrylate particles (diameter 1.5 μm) | 0.2 |
| W-1 | 0.02 |
| H-1 | 0.4 |

-continued

| | |
|---|---|
| Cpd-5 | 1.0 |

Each of layers also contained B-1 as a viscosity enhancer in addition to the above listed ingredients. The total amount of B-1 applied in the coatings was 0.177 g/m$^2$.

UV-1

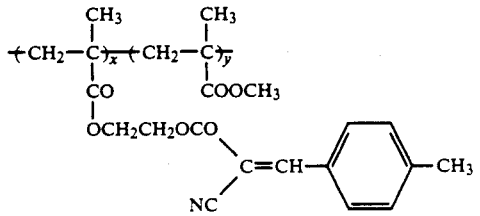

x/y = 7/3 (weight ratio)

UV-2

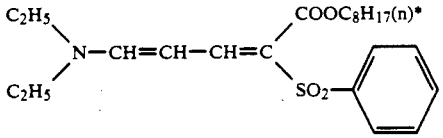

(*hereinafter some of n-alkyl groups are shown without the designation (n))

ExC-1

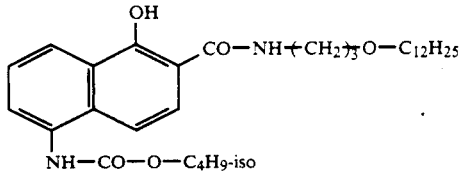

ExC-2

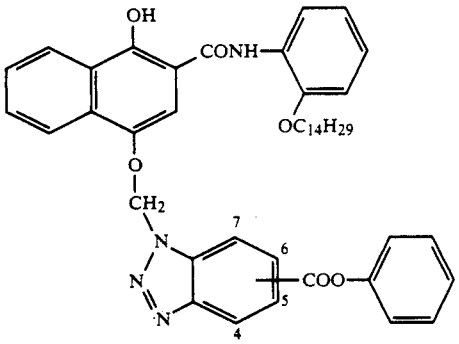

(a mixture of 5- and 6-substituted compounds: the same hereinafter)

ExC-3

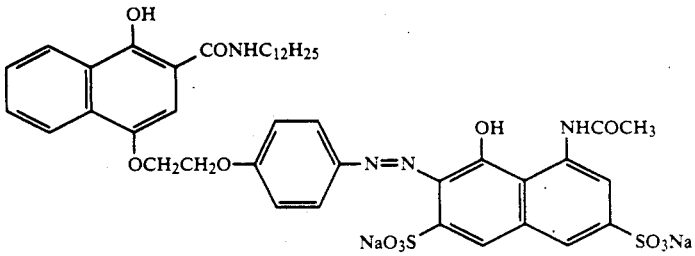

-continued
ExC-4
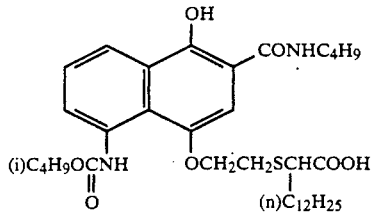
ExC-5
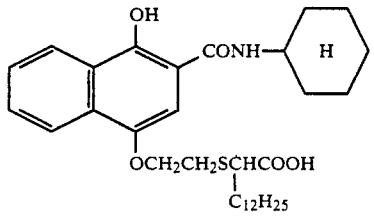
ExC-6
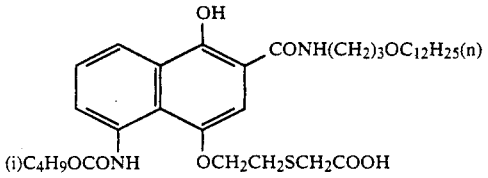
ExM-1
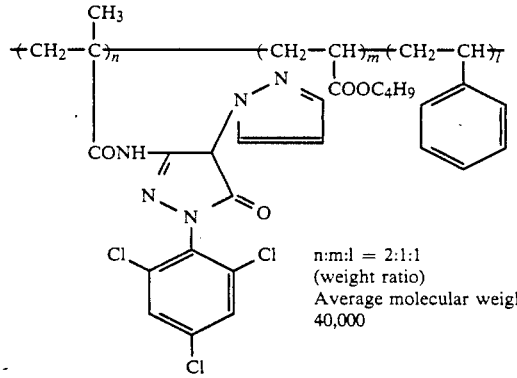
n:m:l = 2:1:1
(weight ratio)
Average molecular weight:
40,000
ExM-2
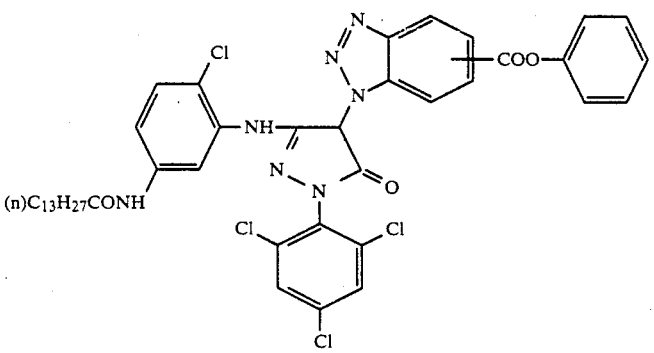

-continued
ExM-3
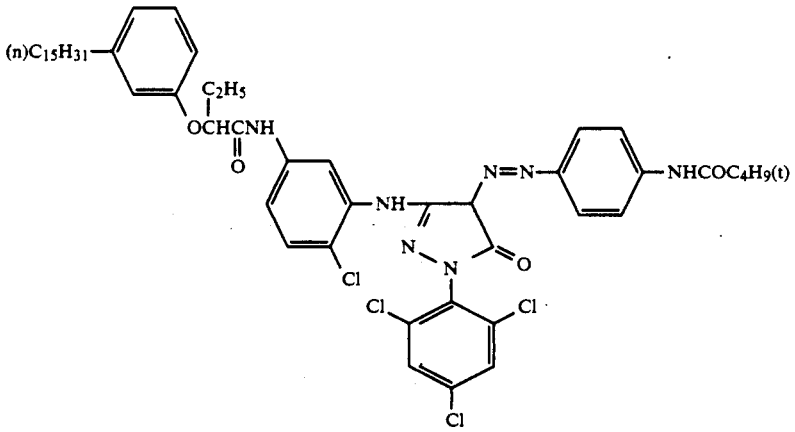
ExM-4
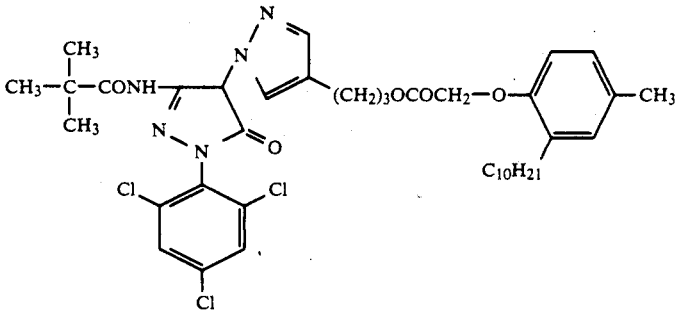
ExM-5
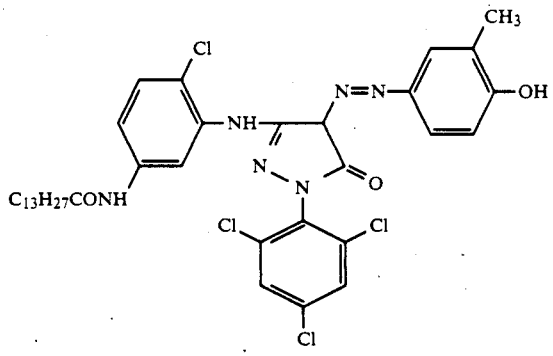
ExY-1
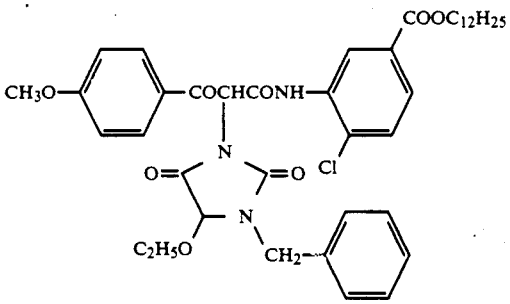
ExY-2
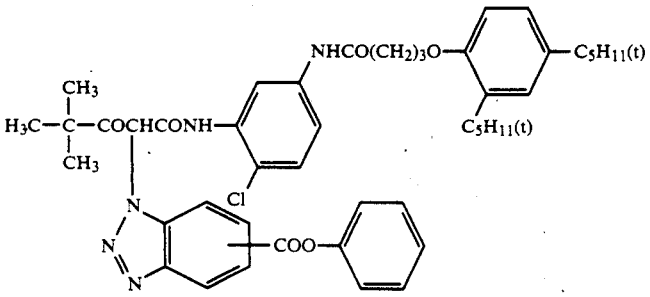

-continued
ExS-1
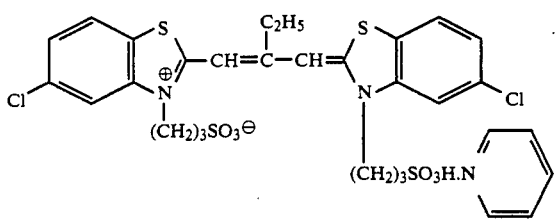
ExS-2
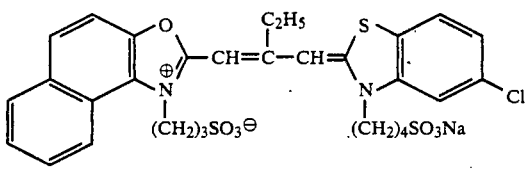
ExS-3
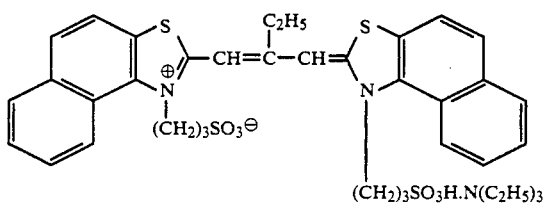
ExS-4
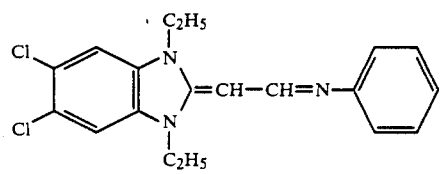
ExS-5
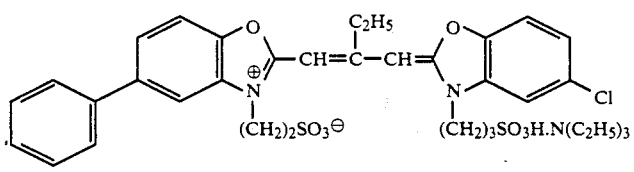
ExS-6
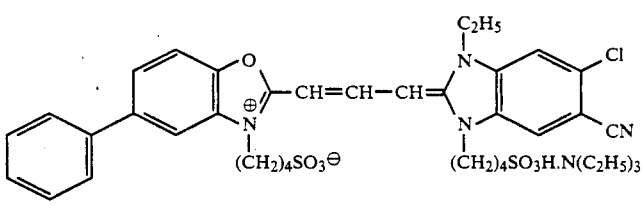
ExS-7
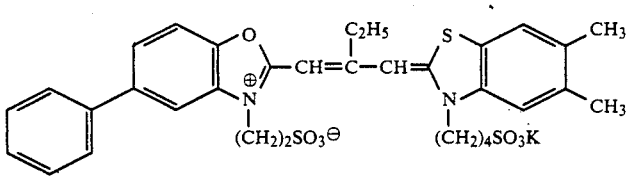
ExS-8
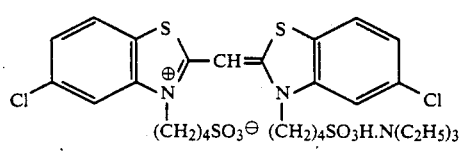
Solv-1
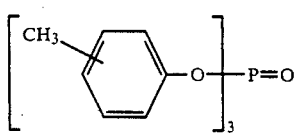

-continued
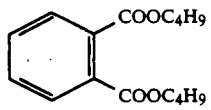
Solv-2
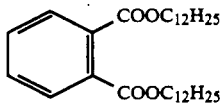
Solv-3
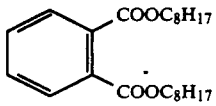
Solv-4
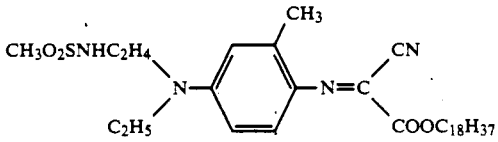
Cpd-1
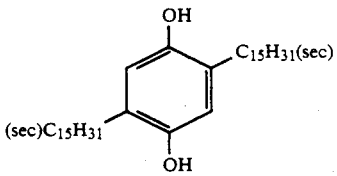
Cpd-2
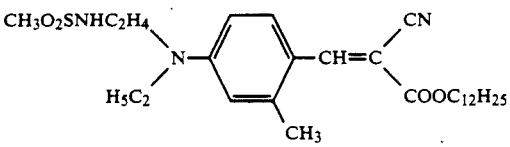
Cpd-3
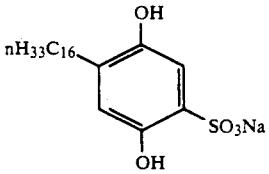
Cpd-4
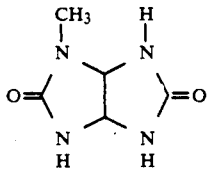
Cpd-5
$C_8F_{17}SO_2NHCH_2CH_2CH_2OCH_2CH_2N^{\oplus}(CH_3)_3$
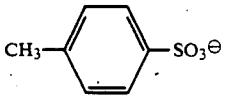
W-1
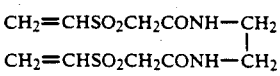
H-1

-continued

B-1

(Polymer)

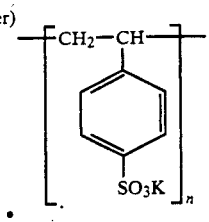

MW: 1,500,000–2,000,000

Sample 102 was prepared in the same manner as Sample 101 but with reduced potassium ion content. The potassium ion content was reduced by the method described below. The B-1 which was used in the preparation emulsions and emulsified substances in Sample 101 has potassium ion as the counter ion. This compound was substituted with a corresponding compound having sodium ion as the counter ion. Additionally, the potassium ion in sensitizing dye ExS-7 were substituted with sodium ion. Also, sodium salts rather than potassium salts were used as the alkali halide in formation of silver halide particles and in adjusting the pAg of the silver halide emulsions. An equimolar amount of sodium salt with respect to potassium salts was used.

The potassium ion content of Samples 101 and 102 was determined using atomic absorption spectroscopic analysis. The samples were prepared for analysis using the method described below. 2 cm×5 cm (10 $cm^2$) pieces of film were cut from the samples, and then 5 ml of $H_2SO_4$ and 3.5 ml of $HNO_3$ were used to turn them to ash using the wet method, and then $H_2O$ were added to make the resultant 10 ml. Additionally, the operations were repeated not using any sample, but just using the $H_2SO_4$ and $HNO_3$. 5 standard solutions were prepared and known quantities of potassium ion were added to make solutions for preparing a calibration curve. A Hitachi-Zeman type atomic absorption spectroscope was used in the flame light mode to perform the measurements.

Table 1 below shows the ratio of potassium ion content to the amount of silver in Samples 101 and 102.

TABLE 1

| Sample No. | Potassium/Silver (weight ratio) |
|---|---|
| 101 | $8.9 \times 10^{-3}$ |
| 102 | $1.8 \times 10^{-4}$ |

These two types of Samples were stored under the storage conditions (A) and (B) shown in Table 2 and then normal methods were used to determine sensitometric characteristics (sensitivity, fogging) and graininess using a wedge exposure and normal processing as detailed below. Sensitometric measurements were made for blue, green and red light, and graininess was measured.

Processing Method

| Processing Step | Processing time | Temperature (°C.) |
|---|---|---|
| Color development | 3 min. 15 sec. | 38 |
| Bleaching | 6 min. 30 sec. | 38 |
| Water washing | 2 min. 10 sec. | 24 |
| Fixing | 4 min. 20 sec. | 38 |
| Water washing (1) | 1 min. 05 sec. | 24 |
| Water washing (2) | 2 min. 10 sec. | 24 |
| Stabilizing | 1 min. 05 sec. | 38 |

-continued

| Processing Step | Processing time | Temperature (°C.) |
|---|---|---|
| drying | 4 min. 20 sec. | 55 |

Processing solutions are shown below:

| | (Units: g) |
|---|---|
| (Color Developing Solution) | |
| Diethylene triamine tetraacetic acid | 1.0 |
| 1-Hydroxyethylidene-1,1-diphosphonate | 3.0 |
| Sodium sulfite | 4.0 |
| Potassium carbonate | 30.0 |
| Potassium bromide | 1.4 |
| Potassium iodide | 1.5 mg |
| Hydroxyamine sulfate salts | 2.4 |
| 4-(N-Ethyl-N-β-hydroxyethylamino)-2-methyl-aniline sulfate salts | 4.5 |
| Water added to make | 1.0 l |
| pH | 10.05 |
| (Bleaching Solution) | |
| Iron (III) sodium salt of ethylene diamine tetraacettic acid | 100.0 |
| Disodium salt of ethylene diamine tetraacetic acid | 10.0 |
| Ammonium bromide | 140.0 |
| Ammonium nitrate | 30.0 |
| Ammonia water (27%) | 6.5 ml |
| Water added to make | 1.0 l |
| pH | 6.0 |
| (Fixing Solution) | |
| Disodium salt of ethylene diamine tetraacetic acid | 0.5 |
| Sodium sulfite | 7.0 |
| Sodium bisulfite | 5.0 |
| Ammonium thiosulfate aqueous solution (70%) | 170.0 ml |
| Water added to make | 1.0 l |
| pH | 6.7 |
| (Stabilizering Solution) | |
| Formalin (37%) | 2.0 ml |
| Polyoxyethylene-p-monononylphenyl ether (average degree of polymerization: 10) | 0.3 |
| Disodium salt of ethylene diamine tetraacetic acid | 0.05 |
| Water added to make | 1.0 l |
| pH | 5.0–8.0 |

TABLE 2 (Storage Conditions)

(A) Processed Immediately (B) Processed after storage for 2 years under natural conditions inside of the Ashigara Research Institute of Fuji Film Photo Co., Ltd. in Minami-ashigara City, Kanagawa Prefecture (about 23° C., 55% RH)

The results of the measurements on the two types of Samples are shown in Table 3. The data on fogging and R.M.S. in the Table is for red light, but similar results were obtained when the same measurements were made with blue and green light. The R.M.S. value is a relative value with respect to a value of 100 which was assigned to Sample 101 (A).

TABLE 3

| Sample No. | Storage Conditions | Specific photo-sensitivity | Fogging (red) | R.M.S. (red) |
|---|---|---|---|---|
| 101 | (A) | 1540 | 0.22 | 100 |
| | (B) | 1401 | 0.30 | 125 |
| 102 (This Invention) | (A) | 1522 | 0.23 | 102 |
| | (B) | 1422 | 0.28 | 119 |

Specific photosensitivity was measured as follows:

Exposure corresponding to the densities higher than the minimum densities of their respective colors, blue, green and red, by 0.15, are expressed in terms of lux.sec, and represented by HB, HG and HR, respectively. The higher of the HB and HR value (the lower sensitivity) is taken as the HS. The specific photosensitivity S is defined by the following equation:

$$S = \sqrt{2/HG \cdot HS}$$

Thus, the higher the specific photosensitivity S, the higher the sensitivity of the sample.

Fogging was measured using the minimum density of the so-called characteristics curve obtained by sensitometry; the higher the value, the higher and more problematic is the fogging.

Graininess (R.M.S) was measured using the lowest density +0.1 of the color image by scanning with microdensitometer having a scan diameter of 48 μm. The standard deviation of the variation in the density value was determined. The higher the value, the rougher and more problematic the grain.

As is clear from Table 3, Sample 102 of this invention had slightly lower sensitivity under storage condition (A) compared with Sample 101, and graininess was at about the same level as that of Sample 101. However, under storage condition (B), Sample 102 of this invention exhibited lower increases in fogging than did Sample 101, and deterioration in graininess was also less.

EXAMPLE 2

High sensitivity multi-layered color negative photosensitive materials were prepared by applying the below described layers 1 through 16 to an undercoated cellulose triacetate film support. The silver weight totalled 9.6 g/m². This photosensitive material was called Sample 201.

Composition of the Photographic Layer

The figures for each of the components express unit of g/m², and those for the silver halides are converted to terms of silver weight. However, with regard to the sensitizing dyes, the figures express moles per mole silver halide in that layer.

| | |
|---|---|
| 1st Layer: Antihalation Layer: | |
| Gelatin layer containing: | |
| Black colloidal silver (silver content) | 0.18 |
| UV-1 | 0.12 |
| UV-2 | 0.17 |
| 2nd Layer: Intermediate Layer: | |
| Gelatin layer containing: | |
| Cpd-2 | 0.18 |
| ExM-9 | 0.11 |
| Silver iodobromide emulsion (sphere equivalent diameter 0.07 μm, AgI 1 mol %) (silver content) | 0.15 |
| 3rd Layer: First Red-sensitive Layer: | |
| Gelatin layer containing: | |
| Silver iodobromide emulsion (sphere equivalent diameter 0.9 μm, AgI 6 mol %) (silver content) | 0.72 |
| ExS-9 | $7.0 \times 10^{-5}$ |
| ExS-10 | $2.0 \times 10^{-5}$ |
| ExS-11 | $2.8 \times 10^{-5}$ |
| ExS-4 | $2.0 \times 10^{-5}$ |
| ExC-7 | 0.093 |
| ExC-8 | 0.31 |
| ExC-2 | 0.010 |
| 4th Layer: Second Red-sensitive Emulsion Layer: | |
| Gelatin layer containing: | |
| Silver iodobromide emulsion (sphere equivalent diameter 1.3 μm, AgI 10 mol %) (silver content) | 1.2 |
| ExS-9 | $5.2 \times 10^{-5}$ |
| ExS-10 | $1.5 \times 10^{-5}$ |
| ExS-11 | $2.1 \times 10^{-5}$ |
| ExS-4 | $1.5 \times 10^{-5}$ |
| ExC-7 | 0.10 |
| ExC-8 | 0.061 |
| ExC-5 | 0.046 |
| 5th Layer: Third Red-sensitive Emulsion Layer: | |
| Gelatin layer containing: | |
| Silver iodobromide emulsion (sphere equivalent diameter 2.0 μm, AgI 10 mol %) (silver content) | 2.0 |
| ExS-9 | $5.5 \times 10^{-5}$ |
| ExS-10 | $1.6 \times 10^{-5}$ |
| ExS-11 | $2.2 \times 10^{-5}$ |
| ExC-4 | $1.6 \times 10^{-5}$ |
| ExC-8 | 0.044 |
| ExC-5 | 0.16 |
| 6th Layer: Intermediate Layer: | |
| Gelatin layer | |
| 7th Layer: First Green-sensitive Emulsion Layer: | |
| Gelatin layer containing: | |
| Silver iodobromide emulsion (sphere equivalent diameter 0.7 μm, AgI 6 mol %) (silver content) | 0.55 |
| ExS-12 | $3.8 \times 10^{-4}$ |
| ExS-7 | $3.0 \times 10^{-5}$ |
| ExS-13 | $1.2 \times 10^{-4}$ |
| ExM-6 | 0.29 |
| ExM-7 | 0.040 |
| ExM-3 | 0.055 |
| ExM-2 | 0.058 |
| 8th Layer: Second Green-sensitive Emulsion Layer: | |
| Gelatin layer containing: | |
| Silver iodobromide emulsion (sphere equivalent diameter 1.3 μm, AgI 8 mol %) (silver content) | 1.0 |
| ExS-12 | $2.7 \times 10^{-4}$ |
| ExS-7 | $2.1 \times 10^{-5}$ |
| ExS-13 | $8.5 \times 10^{-5}$ |
| ExM-6 | 0.25 |
| ExM-7 | 0.013 |
| ExM-3 | 0.009 |
| ExM-2 | 0.011 |
| 9th Layer: Third Green-sensitive Emulsion Layer: | |
| Gelatin layer containing: | |
| Silver iodobromide emulsion (sphere equivalent diameter 2.0 μm, AgI 10 mol %) (silver content) | 2.0 |
| ExS-12 | $3.0 \times 10^{-4}$ |
| ExS-7 | $2.4 \times 10^{-5}$ |
| ExS-13 | $9.5 \times 10^{-5}$ |
| ExM-8 | 0.070 |
| ExM-7 | 0.013 |
| 10th Layer: Yellow Filter Layer: | |
| Gelatin layer containing: | |
| Yellow colloidal silver (silver content) | 0.08 |
| Cpd-2 | 0.031 |
| 11th Layer: First Blue-sensitive Emulsion Layer: | |
| Gelatin layer containing: | |
| Silver iodobromide emulsion (sphere | 0.32 |

-continued

| | |
|---|---|
| equivalent diameter 0.6 μm, AgI 6 mol %) (silver content) | |
| ExY-1 | 0.68 |
| ExY-2 | 0.030 |
| 12th Layer: Second Blue-sensitive Emulsion Layer: | |
| Gelatin layer containing: | |
| Silver iodobromide emulsion (sphere equivalent diameter 1.2 μm, AgI 10 mol %) (silver content) | 0.30 |
| ExY-1 | 0.22 |
| ExS-14 | $2.2 \times 10^{-4}$ |
| 13th Layer: Gelatin Layer: | |
| 14th Layer: Third Blue Sensitive Emulsion Layer: | |
| Gelatin layer containing: | |
| Silver iodobromide emulsion (sphere equivalent diameter 2.2 μm, AgI 13 mol %) (silver content) | 0.80 |
| ExY-1 | 0.19 |

-continued

| | |
|---|---|
| ExY-3 | 0.001 |
| ExS-14 | $2.3 \times 10^{-4}$ |
| 15th Layer: First Protective Layer: | |
| Gelatin layer containing: | |
| UV-1 | 0.14 |
| UV-2 | 0.22 |
| 16th Layer: Second Protective Layer: | |
| Gelatin layer containing: | |
| Polymethyl methacrylate particles (diameter 1.5 μm) | 0.05 |
| Silver iodo-bromide emulsion (sphere equivalent diameter 0.07 μm, AgI 2 mol %) (silver content) | 0.30 |

In addition to the above, gelatin hardeners and surfactants were added to each of layers. In addition, each of layers also contained B-1 as a viscosity enhancer. Total content of B-1 was 0.116 g/m$^2$.

ExC-7

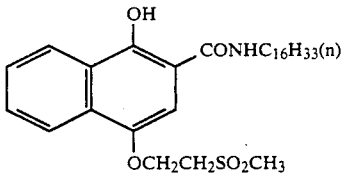

ExC-8

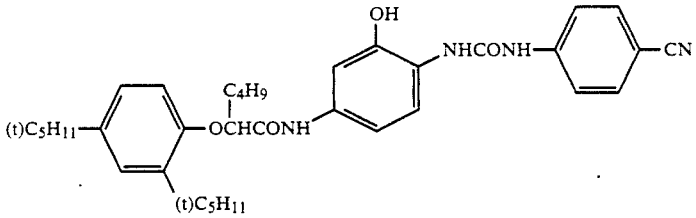

ExM-6

Polymer of:

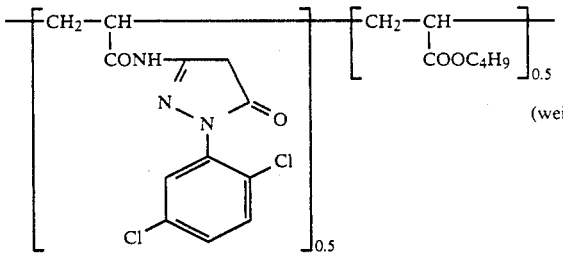

(weight ratio)

average MW: 4,000

ExM-7

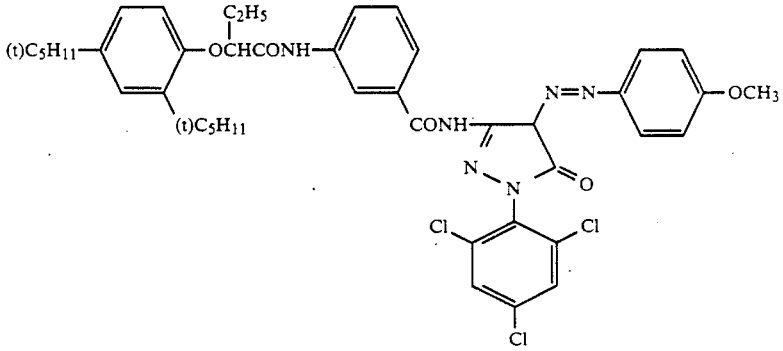

-continued
ExM-8
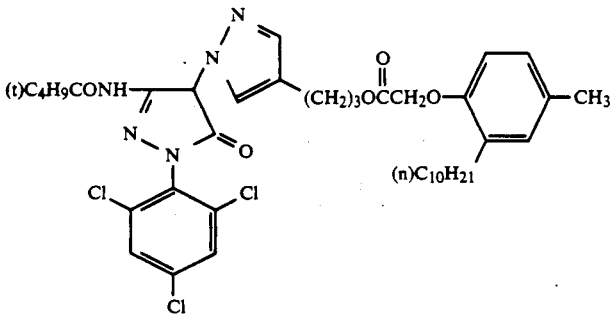
ExM-9
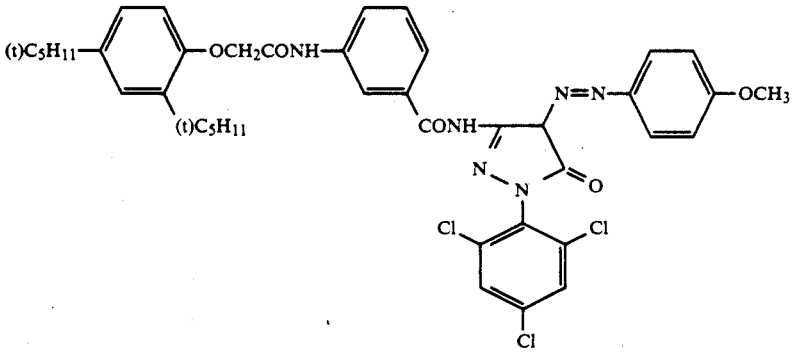
ExY-3
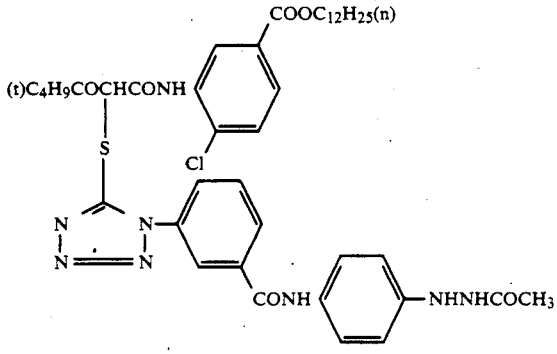
ExS-9
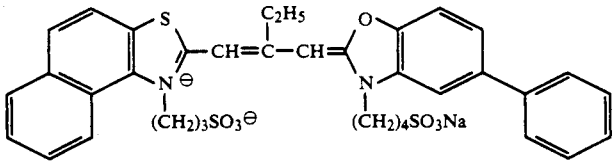
ExS-10
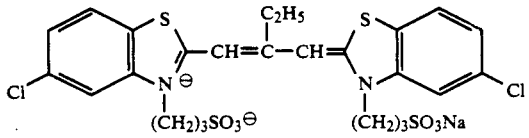
ExS-11
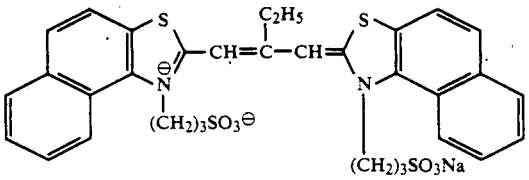

-continued

ExS-12

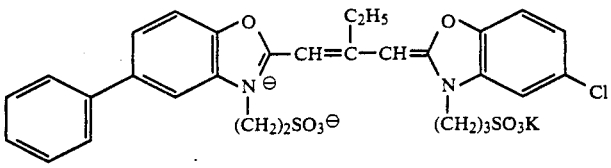

ExS-13

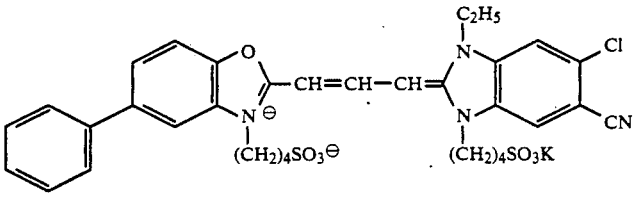

ExS-14

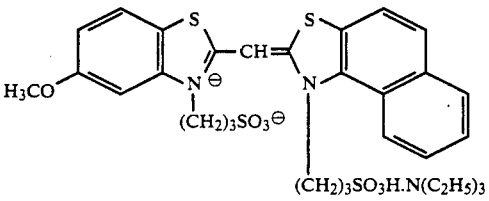

The potassium ion content was reduced from Sample 201 to produce Sample 202. The same methods as used in Example 1 were used to reduce the content of potassium ion. The emulsion coating of layers 3, 4, 5, 7, 8, 9, 11, 12 and 14 was reduced to 85% of what it was for Sample 202 to produce Sample 203. Analysis was performed as in Example 1 for the potassium content of Samples 201 to 203. Table 5 shows the potassium ion for the samples.

TABLE 5

| Sample No. | Potassium/Silver (weight ratio) |
|---|---|
| 201 | $8.0 \times 10^{-3}$ |
| 202 | $1.4 \times 10^{-4}$ |
| 203 | $2.0 \times 10^{-4}$ |

After storing these three types of Samples as in Example 1 under the storage conditions (A) and (B) as shown in Table 3, sensitometric properties and graininess were measured. These measurement results are shown in Table 6. The R.M.S. value is a relative value based on an index of 100 for Sample 201 which was stored under the storage conditions (A).

TABLE 6

| Sample No. | Storage Conditions | Specific photo-sensitivity | Fogging (red) | R.M.S. (red) |
|---|---|---|---|---|
| 201 | (A) | 1650 | 0.26 | 100 |
| | (B) | 1129 | 0.42 | 161 |
| 202 (This | (A) | 1612 | 0.27 | 105 |
| Invention) | (B) | 1227 | 0.38 | 144 |
| 203 (This | (A) | 1504 | 0.24 | 107 |
| Invention) | (B) | 1310 | 0.31 | 132 |

As is clear from Table 6, the Sample 202 of this invention exhibited slightly lower sensitivity and slightly worse than did comparative sample 201 graininess under storage condition (A), but under storage condition (B), the effects of reducing potassium ions appeared and the increase in fogging and deterioration of graininess were both retarded. It also held back the decline in sensitivity. These effects were even more dramatic with respect to Sample 203. In other words, compared with comparative Sample 201, the samples of this invention, Samples 202 and 203, exhibited less deterioration in photographic properties with time.

The reason why Sample 203 showed even more improvement than Sample 202 is believed to be due to the difference in the amount of silver applied in the coatings. The silver amounts in Samples 202 and 203 were 9.6 g/m² and 8.2 g/m² respectively. Thus, when the amount of silver is not more than 9.0 g/m², the greater the effects (in improving of storability) obtained by the reduction in potassium ions.

EXAMPLE 3

High sensitivity multi-layered color negative photosensitive materials were prepared with the below described layers 1 through 15 being applied to an undercoated cellulose triacetate film support. The total weight of silver applied was 7.2 g/m². This photosensitive materials was called Sample 301.

The figures for each of the components express unit of g/m², and those for the silver halides are converted to terms of silver weight. However, with regard to the sensitizing dyes, the figures express moles per mole silver halide in that layer.

| (Composition of the Photographic Layers) | |
|---|---|
| 1st Layer: Antihalation Layer: | |
| Black colloidal silver (silver content) | 0.18 |
| Gelatin | 0.40 |
| 2nd Layer: Intermediate Layer: | |
| Cpd-2 | 0.18 |
| ExM-7 | 0.07 |
| ExC-3 | 0.02 |
| Cpd-7 | 0.002 |
| UV-3 | 0.06 |
| UV-4 | 0.08 |
| UV-5 | 0.10 |
| Solv-1 | 0.10 |
| Solv-2 | 0.02 |
| Gelatin | 1.04 |
| 3rd Layer: First Red-Sensitive Emulsion Layer: | |
| Silver iodobromide emulsion (AgI 4.3 mol %, intermediate high | 0.25 |

-continued

| (Composition of the Photographic Layers) | |
|---|---|
| AgI content type, sphere equivalent diameter 0.45 μm, sphere equivalent diameter variation coefficient 27%, diameter/thickness ratio 1.0) | |
| (Silver content) | |
| Silver iodobromide emulsion (AgI 8.7 mol %, intermediate high AgI content type, sphere equivalent diameter 0.70 μm, sphere equivalent diameter variation coefficient 14%, diameter/thickness ratio 1.0) | 0.25 |
| (Silver content) | |
| ExS-2 | $6.9 \times 10^{-5}$ |
| ExS-3 | $1.8 \times 10^{-5}$ |
| ExS-1 | $3.1 \times 10^{-4}$ |
| ExC-1 | 0.335 |
| ExC-9 | 0.020 |
| Gelatin | 0.87 |
| 4th Layer: Second Red-Sensitive Emulsion Layer: | |
| Silver iodobromide emulsion (AgI 10 mol %, internally high AgI content type, sphere equivalent diameter 0.75 μm, sphere equivalent diameter variation coefficient 30%, diameter/thickness ratio 2.0) | 1.0 |
| (Silver content) | |
| ExS-2 | $5.1 \times 10^{-5}$ |
| ExS-3 | $1.4 \times 10^{-5}$ |
| ExS-1 | $2.3 \times 10^{-4}$ |
| ExC-1 | 0.400 |
| ExC-3 | 0.050 |
| ExC-9 | 0.015 |
| Gelatin | 1.30 |
| 5th Layer: Third Red-Sensitive Emulsion Layer: | |
| Silver iodobromide emulsion (AgI 16 mol %, internally high AgI content type, sphere equivalent diameter 1.05 μm, sphere equivalent diameter variation coefficient 35%, diameter/thickness ratio 2.0) | 1.60 |
| (Silver content) | |
| ExS-2 | $5.4 \times 10^{-5}$ |
| ExS-3 | $1.4 \times 10^{-5}$ |
| ExS-1 | $2.4 \times 10^{-4}$ |
| ExC-3 | 0.010 |
| ExC-6 | 0.080 |
| ExC-1 | 0.097 |
| Solv-1 | 0.22 |
| Solv-2 | 0.10 |
| Gelatin | 1.63 |
| 6th Layer: Intermediate Layer: | |
| Cpd-6 | 0.040 |
| Solv-1 | 0.020 |
| Gelatin | 0.80 |
| 7th Layer: First Green-Sensitive Emulsion Layer: | |
| Silver iodobromide emulsion (AgI 4.3 mol %, intermediate high AgI content type, sphere equivalent diameter 0.45 μm, sphere equivalent diameter variation coefficient 27%, diameter/thickness ratio 1.0) | 0.15 |
| (Silver content) | |
| Silver iodobromide emulsion (AgI 8.7 mol %, intermediate high AgI content type, sphere equivalent diameter 0.70 μm, sphere equivalent diameter variation coefficient 14%, diameter/thickness ratio 1.0) | 0.15 |
| (Silver content) | |
| ExS-7 | $3.0 \times 10^{-5}$ |
| ExS-15 | $1.0 \times 10^{-4}$ |
| ExS-5 | $3.8 \times 10^{-4}$ |
| ExM-1 | 0.260 |
| ExM-7 | 0.021 |
| ExM-3 | 0.030 |
| ExY-4 | 0.025 |
| Solv-1 | 0.100 |
| Solv-5 | 0.010 |
| Gelatin | 0.63 |

-continued

| (Composition of the Photographic Layers) | |
|---|---|
| 8th Layer: Second Green-Sensitive Emulsion Layer: | |
| Silver iodobromide emulsion (AgI 10 mol %, internally high AgI content type, sphere equivalent diameter 0.75 μm, sphere equivalent diameter variation coefficient 30%, diameter/thickness ratio 2.0) | 0.45 |
| (Silver content) | |
| ExS-7 | $2.1 \times 10^{-5}$ |
| ExS-15 | $7.0 \times 10^{-5}$ |
| ExS-5 | $2.6 \times 10^{-4}$ |
| ExM-1 | 0.094 |
| ExY-4 | 0.018 |
| ExM-3 | 0.026 |
| Solv-1 | 0.160 |
| Solv-5 | 0.008 |
| Gelatin | 0.50 |
| 9th Layer: Third Green-Sensitive Emulsion Layer: | |
| Silver iodobromide emulsion (AgI 10 mol %, internally high AgI content type, sphere equivalent diameter 1.05 μm, sphere equivalent diameter variation coefficient 35%, diameter/thickness ratio 3.0) | 1.2 |
| (Silver content) | |
| ExS-7 | $3.5 \times 10^{-5}$ |
| ExS-15 | $8.0 \times 10^{-5}$ |
| ExS-5 | $3.0 \times 10^{-5}$ |
| ExM-11 | 0.015 |
| ExM-10 | 0.100 |
| ExM-7 | 0.025 |
| Solv-1 | 0.25 |
| Solv-5 | 0.10 |
| Gelatin | 1.54 |
| 10th Layer: Yellow Filter Layer: | |
| Yellow colloidal silver (silver content) | 0.05 |
| Cpd-6 | 0.08 |
| Solv-1 | 0.03 |
| Gelatin | 0.95 |
| 11th Layer: First Blue-Sensitive Emulsion Layer: | |
| Silver iodobromide emulsion (AgI 4.3 mol %, intermediate high AgI content type, sphere equivalent diameter 0.45 μm, sphere equivalent diameter variation coefficient 27%, diameter/thickness ratio 1.0) | 0.08 |
| (Silver content) | |
| Silver iodobromide emulsion (AgI 8.7 mol %, intermediate high AgI content type, sphere equivalent diameter 0.70 μm, sphere equivalent diameter variation coefficient 14%, diameter/thickness ratio 1.0) | 0.07 |
| (Silver content) | |
| Silver iodobromide emulsion (AgI 4.3 mol %, intermediate high AgI content type, sphere equivalent diameter 0.25 μm, sphere equivalent diameter variation coefficient 28%, diameter/thickness ratio 1.0) | 0.07 |
| (Silver content) | |
| ExS-8 | $3.5 \times 10^{-4}$ |
| ExY-1 | 0.721 |
| ExY-4 | 0.042 |
| Solv-1 | 0.28 |
| Gelatin | 1.10 |
| 12th Layer: Second Blue-Sensitive Emulsion Layer: | |
| Silver iodobromide emulsion (AgI 14 mol %, internally high AgI content type, sphere equivalent diameter 0.75 μm, sphere equivalent diameter variation coefficient 25%, diameter/thickness ratio 2.0) | 0.45 |
| (Silver content) | |
| ExS-8 | $2.1 \times 10^{-4}$ |
| ExY-1 | 0.154 |
| ExC-9 | 0.007 |
| Solv-1 | 0.05 |
| Gelatin | 0.78 |

-continued

| (Composition of the Photographic Layers) | |
|---|---|
| 13th Layer: Third Blue-Sensitive Emulsion Layer: | |
| Silver iodobromide emulsion (AgI 14 mol %, internally high AgI content type, sphere equivalent diameter 1.30 μm, sphere equivalent diameter variation coefficient 25%, diameter/thickness ratio 3.0) (Silver content) | 0.77 |
| ExS-8 | $2.2 \times 10^{-4}$ |
| ExY-1 | 0.20 |
| Solv-1 | 0.07 |
| Gelatin | 0.69 |
| 14th Layer: First Protective Layer: | |
| Fine particles of silver iodobromide (AgI 1 mol %, sphere equivalent diameter 0.07 μm) (silver content) | 0.5 |
| UV-1 | 0.11 |
| UV-2 | 0.17 |
| Solv-1 | 0.05 |
| Gelatin | 1.00 |
| 15th Layer: Second Protective Layer: | |
| Polymethyl acrylate particles (diameter 1.5μ) | 0.54 |
| Cpd-5 | 0.20 |
| Gelatin | 1.20 |

In addition to the above listed ingredients, gelatin hardening agent H-1 and surfactants were added into each layer.

Also, each layer included B-1 as a viscosity enhancer. The total amount of B-1 in the coatings was 0.169 g/m$^2$.

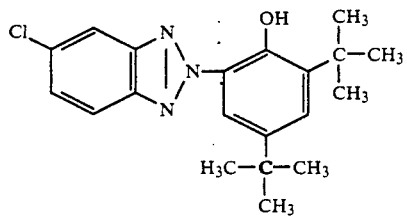

UV-3

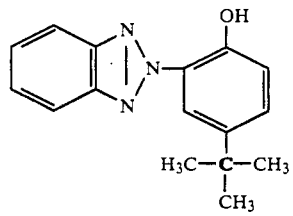

UV-4

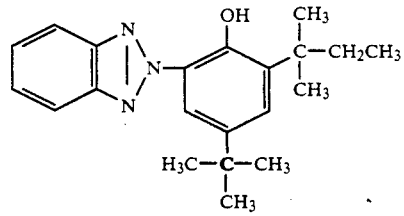

UV-5

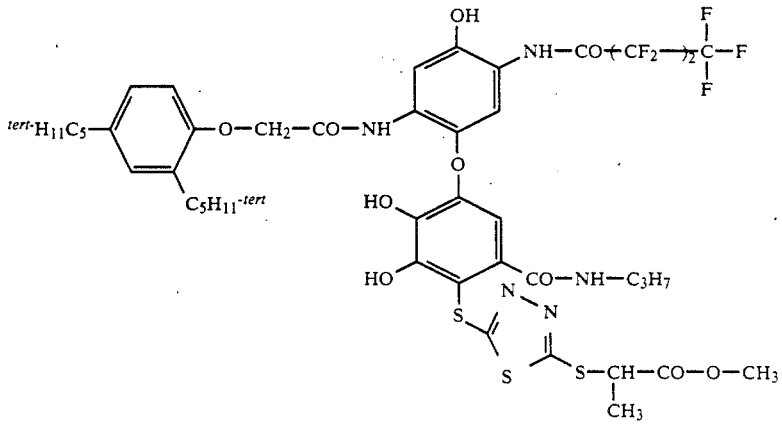

ExC-9

-continued
ExM-10
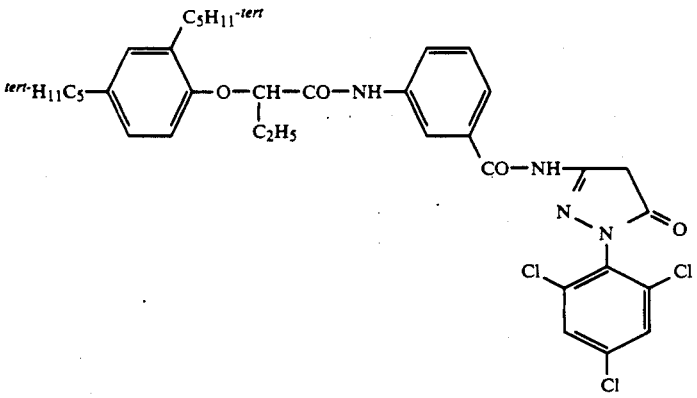
ExM-11
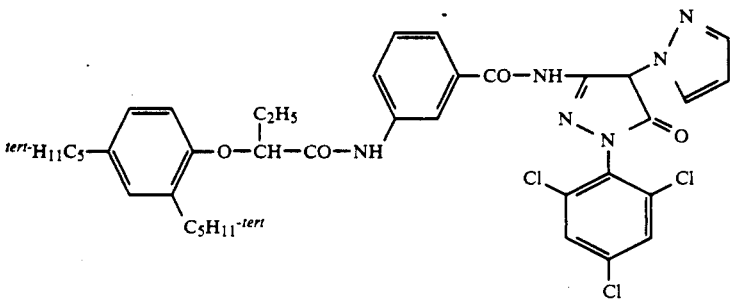
ExY-4
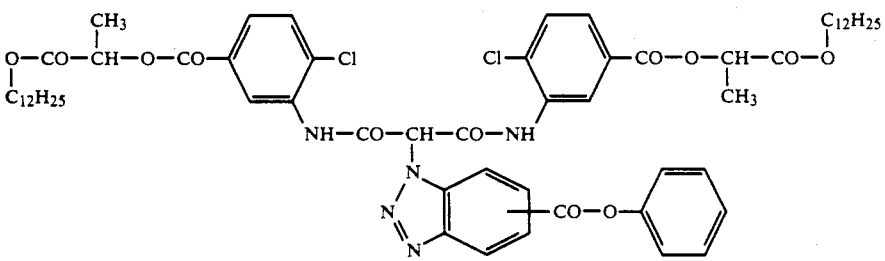
ExS-15
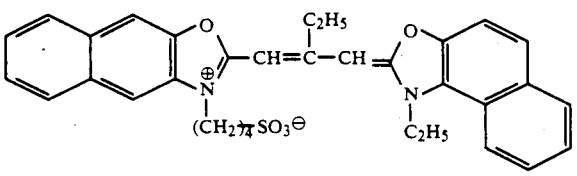
Solv-5
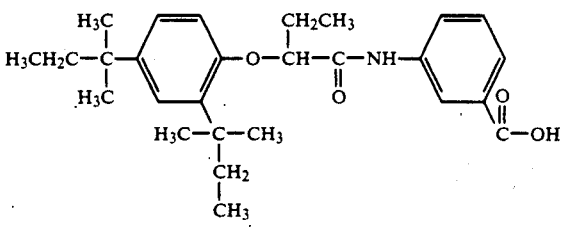
Cpd-6
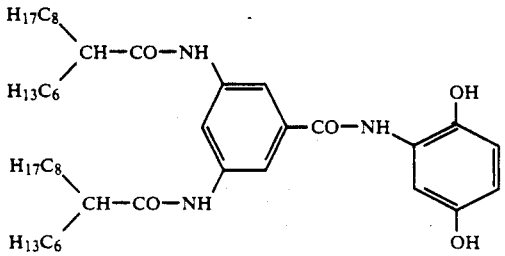

-continued

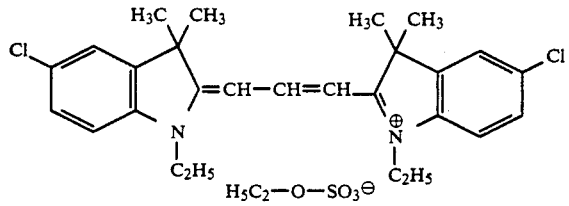

Cpd-7

Sample 302 was prepared in the same manner as Sample 301 but with reduced potassium ion content. The methods used in Example 1 were followed to make this reduction in potassium ions. Sample 303 was then prepared by varying the silver iodo-bromide emulsions in layers 5, 9 and 13 only of Sample 301, and then Sample 304 was prepared as Sample 303 above using methods of Example 1 to reduce the potassium ion content. The same methods were used on Samples 301 to 304 to determine the potassium ion content as were used in Example 1. Those results appear in Table 8.

TABLE 7

| Emulsion Layer | Sample 301 Emulsion | Sample 303 Emulsion |
|---|---|---|
| 5th Layer | Silver iodobromide emulsion (AgI 16 mol %, internally high AgI content type, sphere equivalent diameter 1.05 μm, sphere equivalent diameter variation coefficient 35%, diameter/thickness ratio 2.0) | Silver iodobromide emulsion (AgI 16 mol %, internally high AgI content type, sphere equivalent diameter 0.75 μm, sphere equivalent diameter variation coefficient 37%, diameter/thickness ratio 3.5) |
| 9th Layer | Silver iodobromide emulsion (AgI 10 mol %, internally high AgI content type, sphere equivalent diameter 1.05 μm, sphere equivalent diameter variation coefficient 35%, diameter/thickness ratio 3.0) | Silver iodobromide emulsion (AgI 16 mol %, internally high AgI content type, sphere equivalent diameter 0.75 μm, sphere equivalent diameter variation coefficient 37%, diameter/thickness ratio 3.5) |
| 13th Layer | Silver iodobromide emulsion (AgI 14 mol %, internally high AgI content type, sphere equivalent diameter 1.30 μm, sphere equivalent diameter variation coefficient 25%, diameter/thickness ratio 3.0) | Silver iodobromide emulsion (AgI 14 mol %, internally high AgI content type, sphere equivalent diameter 0.75 μm, sphere equivalent diameter variation coefficient 25%, diameter/thickness ratio 2.0) |

TABLE 8

| Sample No. | Potassium/Silver (weight ratio) |
|---|---|
| 301 | $8.5 \times 10^{-3}$ |
| 302 | $1.9 \times 10^{-4}$ |
| 303 | $7.9 \times 10^{-3}$ |
| 304 | $2.3 \times 10^{-4}$ |

These four types of samples were stored as in Example 1 under storage conditions (A) and (B) and then sensitometric properties and graininess were measured. The results appear in Table 9. The R.M.S. value is a relative value based upon an index of 100 for Sample 301 which was stored under condition (A).

TABLE 9

| Sample No. | Storage Conditions | Specific photo-sensitivity | Fogging (red) | R.M.S. (red) |
|---|---|---|---|---|
| 301 | (A) | 423 | 0.08 | 100 |
| | (B) | 312 | 0.18 | 135 |
| 302 (This Invention) | (A) | 420 | 0.08 | 105 |
| | (B) | 339 | 0.14 | 127 |
| 303 | (A) | 249 | 0.07 | 72 |
| | (B) | 222 | 0.11 | 83 |
| 304 (This Invention) | (A) | 253 | 0.07 | 75 |
| | (B) | 236 | 0.09 | 82 |

As is clear from Table 9, Sample 302 of this invention showed the same level sensitivity and slightly inferior graininess at storage condition (A) as compared with comparison Sample 301, but under storage condition (B), it evidence improved inhibition of fogging and increasing of deterioration in graininess after the passage of time.

Silver halide particles having at least 0.8 μm in sphere equivalent diameter in Sample 301 were replaced with those having less than 0.8 μm to prepare Sample 303. Compared with Sample 301, Sample 303 provided better graininess, but sensitivity was lower. When the potassium ion was in Sample 303 reduced to prepare Sample 304, there were obtained the same level of sensitivity and fogging with slightly worse graininess conditions under storage condition (A), but storage condition (B) obtained slightly higher sensitivity and lower fogging with about the same level of graininess. The improvement in preventing deterioration of photographic properties was clear after the passage of time.

In comparing Sample 301 with 302, and Sample 303 with 304, there is clear difference of the effects of reducing the amount of potassium ions. Namely, compared with Sample 304 Sample 302 showed better improvement effects. This was probably due to the fact that Sample 302 was of higher sensitivity than Sample 304, and Sample 302 contained the large size of the emulsion particles.

While the invention has been described in detail and with reference to specific embodiments thereof, it will be apparent to one skilled in the art that various changes and modifications can be made therein without departing from the spirit and scope thereof.

What is claimed is:

1. A method for imparting storage stability to a high-sensitivity silver halide photographic light-sensitive material comprising determining the potassium content of each ingredient to be included in the photosensitive material and selecting and combining ingredients such that the potassium level of the final photographic light-sensitive material does not exceed 1 part potassium per 1000 parts silver by weight.

2. A method according to claim 1, wherein the ratio by weight of potassium ion contained in the photographic light-sensitive material to the total amount of silver contained in the final photographic material is $5\times10^{-4}$ or less.

3. A method according to claim 1, wherein the ratio by weight of potassium ion contained in the photographic light-sensitive material to the total amount of silver contained in the final photographic material is $3\times10^{-4}$ or less.

4. A method according to claim 1, wherein silver halide particles are contained in a silver halide emulsion layer, and said silver halide particles have a sphere equivalent diameter of at least 0.8 μm.

5. A method as in claim 1, wherein the amount of potassium ion is determined by atomic absorption spectroscopy.

6. A method according to claim 1, wherein specific photosensitivity of the silver of the high-sensitivity silver halide photographic light-sensitive material is 320 or more.

7. A method according to claim 1, wherein the total amount of silver contained in the photographic light-sensitive material is 3.0 to 9.0 g/m$^2$.

8. A method according to claim 1, wherein compounds containing $H^+$, $Li^+$, $Na^+$, $Mg^+$, $Ca^+$ or quaternary ammonium compounds are used in place of compounds containing potassium ion.

9. A method according to claim 1, wherein the high-sensitivity silver halide photographic light-sensitive material has at least one blue-sensitive emulsion layer, at least one green-sensitive emulsion layer, and at least one red-sensitive emulsion layer on the support as light-sensitive silver halide emulsion layers.

10. A method according to claim 9, wherein the specific photosensitivity of the silver of the high-sensitivity silver halide photographic light-sensitive material is 320 or more.

11. A method according to claim 9, wherein the specific photosensitivity of the silver of the high-sensitivity silver halide photographic light-sensitive material is 800 or more.

* * * * *